US005159395A

United States Patent [19]

Farrell et al.

[11] Patent Number: 5,159,395

[45] Date of Patent: Oct. 27, 1992

[54] METHOD OF SCHEDULING COPY SHEETS IN A DUAL MODE DUPLEX PRINTING SYSTEM

[75] Inventors: Michael E. Farrell, Fairport; Frank J. Denunzio, Webster; James F. Matysek, Fairport, all of N.Y.

[73] Assignee: Xerox Corporation, Stamford, Conn.

[21] Appl. No.: 752,108

[22] Filed: Aug. 29, 1991

[51] Int. Cl.[5] ..... G03G 21/00

[52] U.S. Cl. ..... 355/319; 271/291

[58] Field of Search ..... 355/308, 309, 313, 319, 355/324; 271/285, 286, 291

[56] References Cited

U.S. PATENT DOCUMENTS

| | | | |
|---|---|---|---|
| 4,453,841 | 6/1984 | Bobick et al. | 355/319 X |
| 4,466,733 | 8/1984 | Pels | 355/313 |
| 4,595,187 | 6/1986 | Bober | 270/37 |
| 4,708,469 | 11/1987 | Bober et al. | 355/308 X |
| 4,727,402 | 2/1988 | Smith | 355/319 |
| 4,918,490 | 4/1990 | Stemmle | 355/318 |
| 5,095,342 | 3/1992 | Farrell et al. | 355/319 |
| 5,095,369 | 3/1992 | Ortiz et al. | 355/324 |

*Primary Examiner*—Fred L. Braun
*Attorney, Agent, or Firm*—Oliff & Berridge

[57] ABSTRACT

Copy sheets are scheduled for being printed and output by an imaging system according to a method in which the scheduling is selectively conducted in one of a first mode where for each set of copy sheets to be pritned, the copy sheets are consecutively output from the copy sheet paper path without any skipped pitches between each consecutively output copy sheet, and a second mode, where for each set of copy sheets to be printed, the copy sheets are output from the copy sheet paper path with skipped pitches between at least some of the consecutively output copy sheets. The second mode of operation results in copy sheets being output from the imaging device at a lower frequency than in the first mode.

28 Claims, 13 Drawing Sheets

METHOD OF SCHEDULING COPY SHEETS IN A DUAL MODE DUPLEX PRINTING SYSTEM

CROSS REFERENCES

This application is related to U.S. Pat. No. 5,095,342, to Michael E. Farrell et al entitled "METHODS FOR SHEET SCHEDULING IN AN IMAGING SYSTEM HAVING AN ENDLESS DUPLEX PAPER PATH LOOP". This application is also related to U.S. patent application Ser. No. 07/752,123 to Michael E. Farrell et entitled "DUPLEX PRINTING SCHEDULING SYSTEM COMBINING FINISHER INTERSET SKIPPED PITCHES WITH DUPLEX SHEET SCHEDULING", filed concurrently herewith. The disclosures of the above listed applications are incorporated herein by reference.

BACKGROUND OF THE INVENTION

1. Field of the Invention

The present invention is directed generally to printing duplex and simplex copy sheets from electronic page information, especially suitable for low cost electrostatographic, ink jet, ionographic or other on-demand page printers with an endless duplex paper path loop. More particularly, the present invention relates to such printers which are integrated with on-line finishing devices.

2. Description of Related Art

The terminology "copiers", and "copies", as well as "printers" and "prints", is used alternatively herein. The terminology "imaging" and "marking" is used alternatively herein and refers to the entire process of putting an image (digital or analog source) onto paper. The image can then be permanently fixed to the paper by fusing, drying, or other means. It will be appreciated that the invention may apply to almost any system in which the images are made electronically, including electronic copiers.

Imaging systems (e.g., printers or copiers) typically include copy sheet paper paths through which copy sheets (e.g., plain paper) which are to receive an image are conveyed and imaged. The process of inserting copy sheets into the copy sheet paper path and controlling the movement of the copy sheets through the paper path to receive an image on one or both sides, is referred to as "scheduling". Copy sheets are printed by being passed through a copy sheet paper path (which includes a marking station) one or multiple times. Copy sheets which are printed on only one side (simplex copy sheets) in a single color usually pass through the copy sheet paper path a single time. Multipass printing is used to print images on both sides of a copy sheet (duplex printing), or to print a simplex sheet in multiple colors (one pass for each color). There are two general modes in which copy sheets to be multipass printed can be scheduled: "burst mode" and "interleave mode".

When scheduling in "burst mode", copy sheets are inserted into, imaged, and output from the copy sheet paper path without any "skipped pitches" existing between each consecutive copy sheet. A "pitch" is the portion (or length) of the copy sheet paper path in the process direction which is occupied by a copy sheet as it moves through the copy sheet paper path. A "skipped pitch" occurs when there is a space between two consecutively output copy sheets which is long enough to hold another copy sheet. Accordingly, when scheduling in "burst mode", copy sheets are output from the copy sheet paper path (and, thus, the imaging system) at a maximum rate because no skipped pitches exist between each consecutive copy sheet.

Various methods for scheduling copy sheets in "burst mode" are disclosed in, for example, the above incorporated U.S. Pat. No. 5,095,342.

When scheduling copy sheets in "interleave mode", skipped pitches are provided between each consecutively scheduled copy sheet. That is, a space is provided between each copy sheet inserted into and output from the copy sheet paper path. While other copy sheets may be eventually inserted in the space between two consecutively input sheets, these other sheets are inserted at a later time (described below) and are thus "interleaved" with the previously inserted copy sheets.

This "interleave mode" of copy sheet scheduling is typically employed in imaging systems which are capable of duplex printing (forming images on both sides of a copy sheet). Many imaging systems which are capable of duplex printing include copy sheet paper paths in the shape of a loop. The scheduling process involves: a) inserting a copy sheet into the loop; b) forming an image on a first side of the copy sheet at an imaging station; c) inverting the copy sheet (so that a second side of the copy sheet will face the imaging station when the copy sheet is reconveyed past the imaging station); d) forming an image on the second side of the copy sheet at the imaging station; and e) outputting the copy sheet from the paper path loop toward a final destination (a tray, a bindexer, finishing devices, etc.).

One reason why the "interleave mode" of scheduling is frequently used when duplex printing relates to the manner in which the original images are provided to the imaging station. For example, when the imaging system is using a recirculating document handler (RDH) to cycle a simplex document over a platen for exposure to a light source for forming duplex copies of the document, the imaging system exposes every other sheet in the simplex document so that a duplex copy of the document can be formed. For example, all even numbered pages in the document are exposed first to form a copy set consisting of copy sheets having even numbered pages on one side. Then, the odd numbered pages in the document are exposed, and these odd numbered pages are formed on the second side of the copy sheets containing the even numbered pages on side one.

The Xerox Corporation "9700" printer, duplex version schedules duplex copy sheets in an interleave mode of operation. It operates in essentially a trayless mode, with a long duplex loop path. Initially, prints (copies) of only the even sides are made, with one skip cycle (skipped pitch) between each print until the entire paper path is filled with even side prints alternated with skipped pitches. When the first completed even side (page 2) reaches the transfer area for the second side print (page 1), that page is printed on the back side. The next print to be made, however, is the next even side in the sequence printed on a blank sheet, and interleaved in the blank spaces (previously skipped pitches) left between sheets on the first pass. Thus, the job then proceeds at full productivity, intermixing (or interleaving) even sides printed on blank sheets for the first pass with odd sides printed on the back of previously completed even sides on their second pass. After the last even side is printed, the system resumes the skip pitch operation until the odd sides are printed on the last of the even side prints.

For a 30 page job, this "9700" printer duplex version page copying sequence can be represented as shown below. [Each "S" represents a skipped pitch. Previously printed sheet pages making their second pass for their second side copy are shown under the slash.]

First stage—[evens copied+skips=half productivity]:

2, S, 4, S, 6, S, 8;

Second stage—[odds and evens intermixed—full productivity]:

---

$\frac{1}{2}$, 10, $\frac{3}{4}$, 12, 5/6, 14, $\frac{7}{8}$, 16, 9/10, 18, 11/12, 20, 13/14, 22, 15/16, 24, 17/18, 26, 19/20, 28, 21/22, 30;

---

Third stage—[odds copied+skips=half productivity];

23/24, S, 25/26, S, 27/28, S, 29/30.

Note that with this "9700" printer sequence, 36 machine pitches are required to make 30 prints. So, for this 30 page job, the overall duplex operation is only 83% efficient. For longer jobs, the effective efficiency improves. But for shorter jobs the overall efficiency degrades, since there will still be 6 skipped pitches—"S".

The sequence used on Xerox Corporation "5700" printer is somewhat similar, except that it is not a trayless duplex loop system. All the completed first side sheets are stacked into a duplex buffer tray and later refed for side two printing. With this system, printer skip pitches are not required during the first stage of the job. The skip pitches are also not required for the third stage since the completed side ones can be fed at full thruput from the duplex tray. Thus, the "5700" duplexing is much more efficient than in the "9700". However, such duplex tray systems are inherently less reliable in some respects. The required duplex tray stacking, reseparating, and refeeding is implicated in the vast majority of duplex paper jams, and complicates job recovery. That is eliminated with the "9700" and other endless moving path duplex buffer loop systems.

Other conventional sequences for printers are also possible. For example, the Hewlett Packard HP "2000" uses a stack and re-feed method of duplex in which all even sides of the entire job are printed, followed by printing all of the odd sides. However, for this, the entire job (all the page images) must be stored in memory in order to insure jam recovery.

It is generally known that electronically inputted printers can desirably provide more flexibility in page sequencing (page, copying presentation order) than copiers with physical document sheet input. The printer input is electronically manipulatable electronic page media, rather than physical sheets of paper which are much more difficult to reorder or manipulate into a desired sequence. As also shown in the art noted hereinbelow, it is generally known that certain such reordered or hybrid document page copying orders or sequences may be copied onto a corresponding sequential train of copy sheets in an appropriate copier or printer to provide higher copying machine productivity yet correct page order copy output, especially for duplex copies made with a copier with trayless duplexing, i.e., providing a limited length endless buffer loop duplexing path for the copy sheets being duplexed.

Thus, electronically inputted imaging systems can operate in "burst mode" even when forming duplex copy sets. When operating in burst mode in an electronically inputted imaging system having an endless buffer loop duplexing paper path (no buffer tray), the duplexing paper path is completely filled with copy sheets (no skipped pitches) which are then imaged on both sides before being output from the duplexing paper path. Duplex burst mode scheduling causes duplex sheets to be output in small bursts of sheets (the duplex loop content) at full rated output.

However, it is becoming increasingly common to integrate on-line finishing devices with imaging systems. These on-line finishing devices directly receive copy sheets as they are output from the imaging system and perform various types of finishing operations on each copy sheet, or on each set of copy sheets. The finishing operations can be, for example: binding, stitching, folding, trimming, aligning, rotating, punching, drilling, slitting, perforating, and combinations thereof.

A problem which arises when integrating an existing finishing device with high speed imaging systems is that the finishing device may not be able to receive copy sheets at as high a frequency as the copy sheets can be output by the imaging system. For example, the imaging system described in U.S. Pat. No. 5,095,342 can output copy sheets at a rate of 135 per minute when operating in "burst mode". This rate is too fast for some finishing devices.

One example involves the use of the imaging system disclosed in U.S. Pat. No. 5,095,342 in connection with an on-line Signature Booklet Maker (SBM) to form signature booklets. A "signature" is a duplex printed copy sheet having two page images on each side. The signature sheet can be folded in half to form a booklet, or a plurality of signatures can be aligned, stitched together, and folded in half to form a multi-sheet booklet. A description of signature printing is provided in U.S. Pat. No. 4,727,042 to Smith, the disclosure of which is incorporated herein by reference. The device disclosed in U.S. Pat. No. 5,095,342 is capable of outputting signatures in bursts at a rate of 135 per minute, but the SBM may not be able to receive sheets at such a high rate.

The SBM can be constructed, for example, from variants of three existing finishing modules such as the AGR/Automatic Stitcher, the PA/Automatic Folder, and the TR/Automatic Trimmer, manufactured by C.P. Bourg for off-line use. All modules require mechanical modification to support front edge registration-vs. center registration and wiring modification to share basic signals with the printer. The printer exports sheet arrival times and end-of-set signals to the SBM equipment. The first module receives and aligns the copy sheets in a set (which set forms a single booklet) so that all sheets in the set are aligned with one another. The first module aligns each sheet by stopping the forward movement of the sheet (e.g., with a gate or sheet stop), and then laterally tapping each sheet against another sheet stop. Once all sheets in the set are received and aligned, the first module stitches or binds all the sheets in the set to each other at a central location (between each page image on each sheet). The stitching step can comprise, for example, stapling. Thus, the first module is referred to as a "saddle stitcher".

The stitched copy set is then forwarded to a second module which folds the stitched copy set in half about the stitch axis. Thus, the second module is referred to as a "folder".

The folded copy set is then forwarded to a third module where the edges of the sheets opposite from the fold are trimmed. Thus, the third module is referred to as a "trimmer". Trimming is necessary, particularly in large sets or booklets, because the edges of the sheets opposite from the fold become uneven after folding.

The time period required to receive and align each sheet in the first module is longer than the time period between the output of each consecutive copy sheet output by the imaging system when operating in "burst mode". Operating the imaging system in "interleave" mode would provide sheets to the SBM on every other pitch—an apparent half rate—thereby allowing adequate time for the SBM to register (receive and align) sheets.

However, using interleave mode scheduling for jobs not destined for the SBM would degrade system productivity by introducing "skipped pitches".

It is also possible to redesign the SBM to operate at a speed appropriate for handling sheets at the high burst mode rate. However, it is risky and expensive to redesign such machines. Additionally, if such machines are originally purchased from vendors, any warranties can be voided by such redesigning. Accordingly, there is a need for an imaging system which optimizes copy sheet output while compensating for differences in the operating rates of any finishing devices used therewith.

U.S. Pat. No. 4,466,733 to Pels, assigned to Xerox Corporation, discloses a method of duplex copying wherein the sequence of document and copy sheet feeding and copying is controlled to provide more efficient and rapid precollation copying. The method automatically selects one of two modes of duplex copying dependent upon the number of documents in a document set. In a formal duplex copying mode, the documents are copied only once in each copying circulation of the document set. Every other page of the document set is copied unidirectionally in reverse (N to 1) page order on only one side of the copy sheets. The copy sheets having been printed on one side are collected and stored in a buffer, forming a buffer set of copy sheets. Then, alternate documents are copied in proper sequence onto the opposite sides of the buffer set sheets to form sets of collated duplex copy sheets. If the number of documents in the document set is determined to be more than three but less than approximately ten, a higher productivity small document set copying mode is automatically selected. In the small document set copying mode, two identical buffer sets of alternate page documents are initially built and stored in the same buffer during two initial copy circulations of the document set. If the number of copy sets made is greater than two, all of the documents are copied in all intermediate document copying circulations to maintain the two buffer sets during the intermediate circulations by simultaneously rebuilding and depleting the two buffer sets. In the last two circulations alternate document pages are copied so that the two buffers are depleted and form sets of collated duplex copies.

U.S. Pat. No. 4,918,490 to Denis J. Stemmle (Xerox Corporation) discloses an endless duplex paper path loop having a single sheet inverter for inverting sheets in the duplex loop after side one imaging. Sheets are consecutively inserted into the duplex loop to avoid the first and third stage skipped pitches discussed above with reference to the "9700" system. Sheets are scheduled in 1-N order, with each multipage job set being electronically divided into consecutive batches, each batch containing a small number of pages equal to approximately twice the copy sheet length.

Also of interest is Mead Corporation U.S. Pat. No. 4,453,841 issued Jun. 12, 1984 to Bobick et al disclosing a trayless duplexing buffer loop path printer system, and noting particularly the page copy sequences shown in FIG. 6.

Some examples of other prior art copiers, and especially with control systems therefor, including operator console switch selection inputs, document sheet detecting switches, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270; and 4,475,156. It is well known in this art, and in general, how to program and execute document handler and copier control functions and logic with conventional or simple software instructions for conventional microprocessors in a copier controller. This is taught by the above and other patents and various commercial copiers. Such software may vary depending on the particular function and particular microprocessor or microcomputer system utilized, of course, but will be available to or readily programmable by those skilled in the applicable arts without experimentation, from either descriptions or prior knowledge of the desired functions together with general knowledge in the general software and computer arts. It is also known that conventional or specified document and copy sheet handling functions and controls may be alternatively conventionally provided utilizing various other known or suitable logic or switching systems.

All references cited in this specification, and their references, are incorporated by reference herein where appropriate for appropriate teachings of additional or alternative details, features and/or technical background.

OBJECTS AND SUMMARY OF THE INVENTION

It is an object of the present invention to provide a method of scheduling copy sheets for being printed and output by imaging devices, such as printers or copiers, which permits the imaging devices to be integrated on-line with an existing finishing device that operates at a slower speed than the imaging device while maintaining as high a productivity as is possible.

It is another object of the present invention to provide a method of scheduling copy sheets for being printed and output by imaging devices which permits the imaging devices to be integrated on-line with finishing devices without requiring any changes in the operating speed of the finishing devices.

To achieve the foregoing and other objects, and to overcome the shortcomings discussed above, copy sheets are scheduled for being printed and output by an imaging device wherein the scheduling is selectively conducted in one of a first mode where, for each set of copy sheets to be printed, the copy sheets are consecutively output from the copy sheet paper path without any skipped pitches between each consecutively output copy sheet, and a second mode, where, for each set of copy sheets to be printed, the copy sheets are output from the copy sheet paper path with skipped pitches between at least some of the consecutively output copy sheets. The second mode of operation results in copy sheets being output from the imaging device at a lower frequency than in the first mode.

When the imaging device is integrated with an on-line finishing device which is not capable of operating at as high a frequency as the maximum frequency of the imaging device, the selection of the appropriate mode of operation is based upon the final destination of each set of copy sheets. Preferably, the imaging device is operated in the first mode unless the final destination is the slower operating finishing device.

When the imaging device is a printer having an endless buffer-trayless duplex paper path loop, the first mode correspond to a burst mode where each consecutive copy sheet is inserted into and output from the duplex paper path loop without any skipped pitches therebetween, and the second mode corresponds to an interleave mode where a skipped pitch is located between each consecutive copy sheet inserted into and output from the duplex paper path loop as described above with respect to the Xerox 9700" printer.

Since the time interval between a leading edge of each adjacent copy sheet in the paper path can vary depending on the size of the copy sheet, the frequency of sheet output can also vary based on the copy sheet size. Accordingly, it may also be appropriate to consider the copy sheet size when determining whether to operate in burst or interleave mode.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENTS

A. The System

Figure 1:
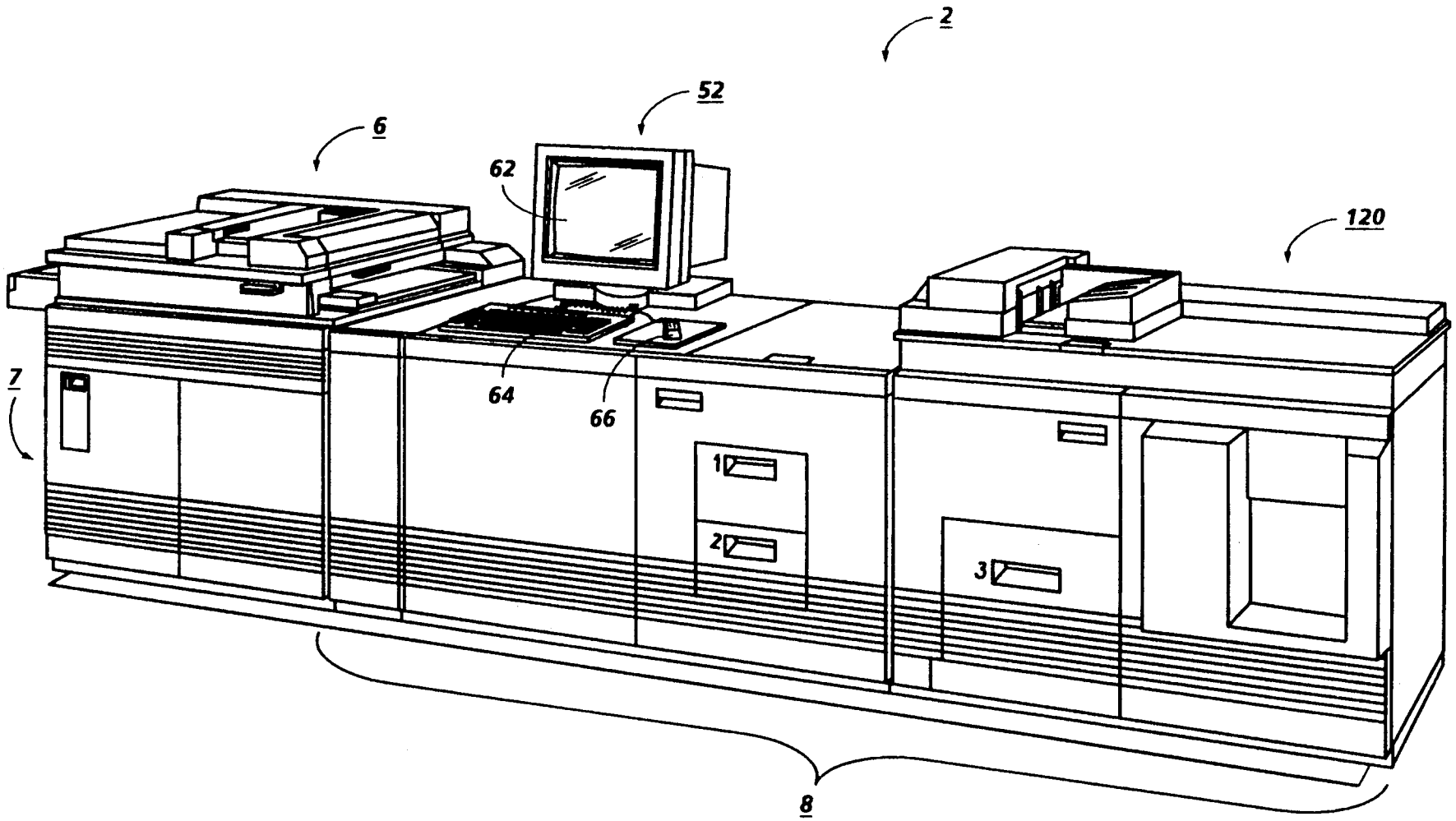
FIG. 1 is a view depicting an electronic printing system.
Figure 2:
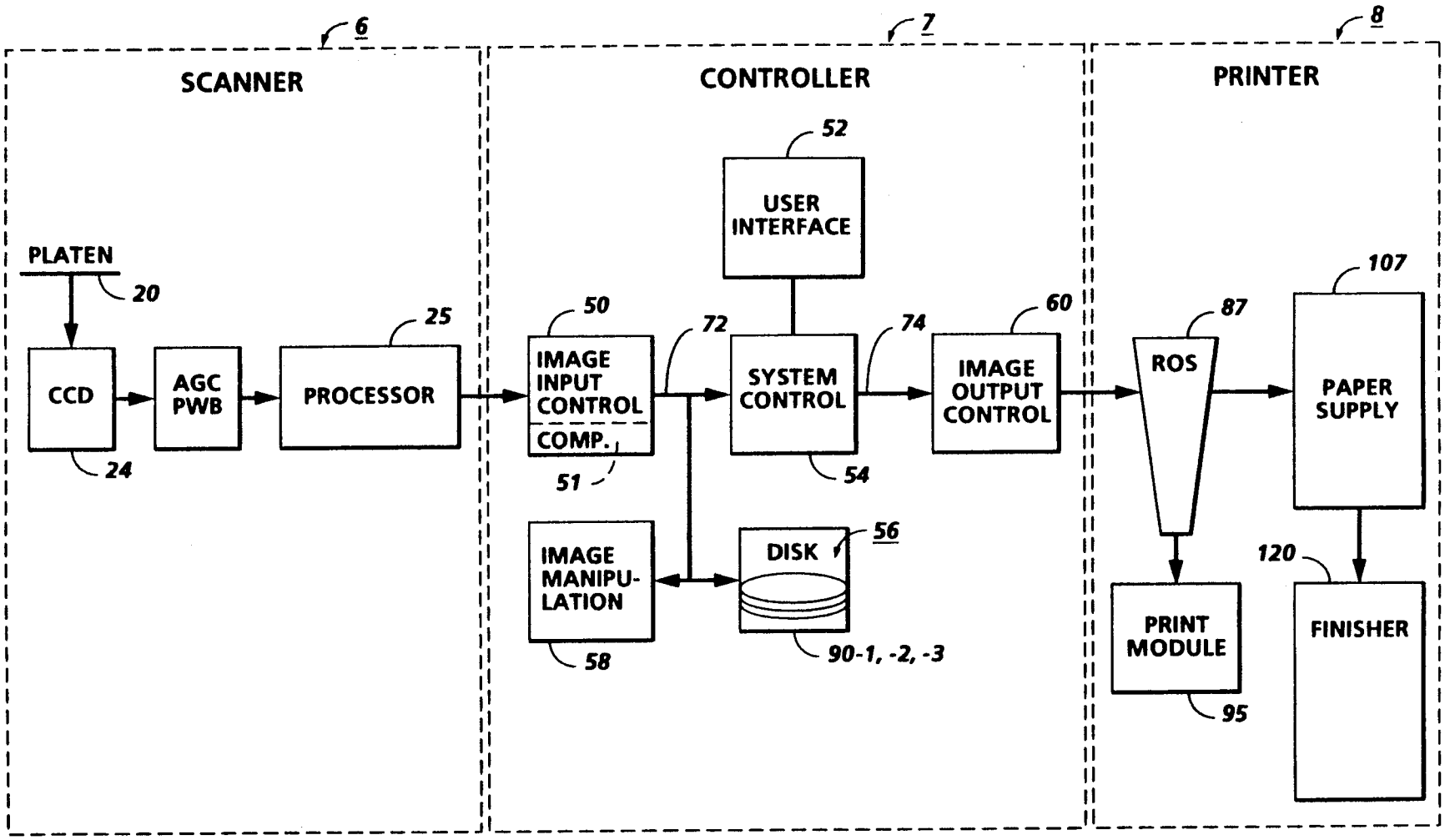
FIG. 2 is a block diagram depicting the major elements of the printing system shown in FIG. 1.

Referring to FIGS. 1 and 2, there is shown an exemplary laser based printing system (or imaging device) 2 for processing print jobs in accordance with the teachings of the present invention. Print system 2, for purposes of explanation, is divided into a scanner section 6, controller section 7, and printer section 8. While a specific printing system is shown and described, the present invention may be used with other types of printing systems such as ink jet, ionographic, etc.

Figure 3:
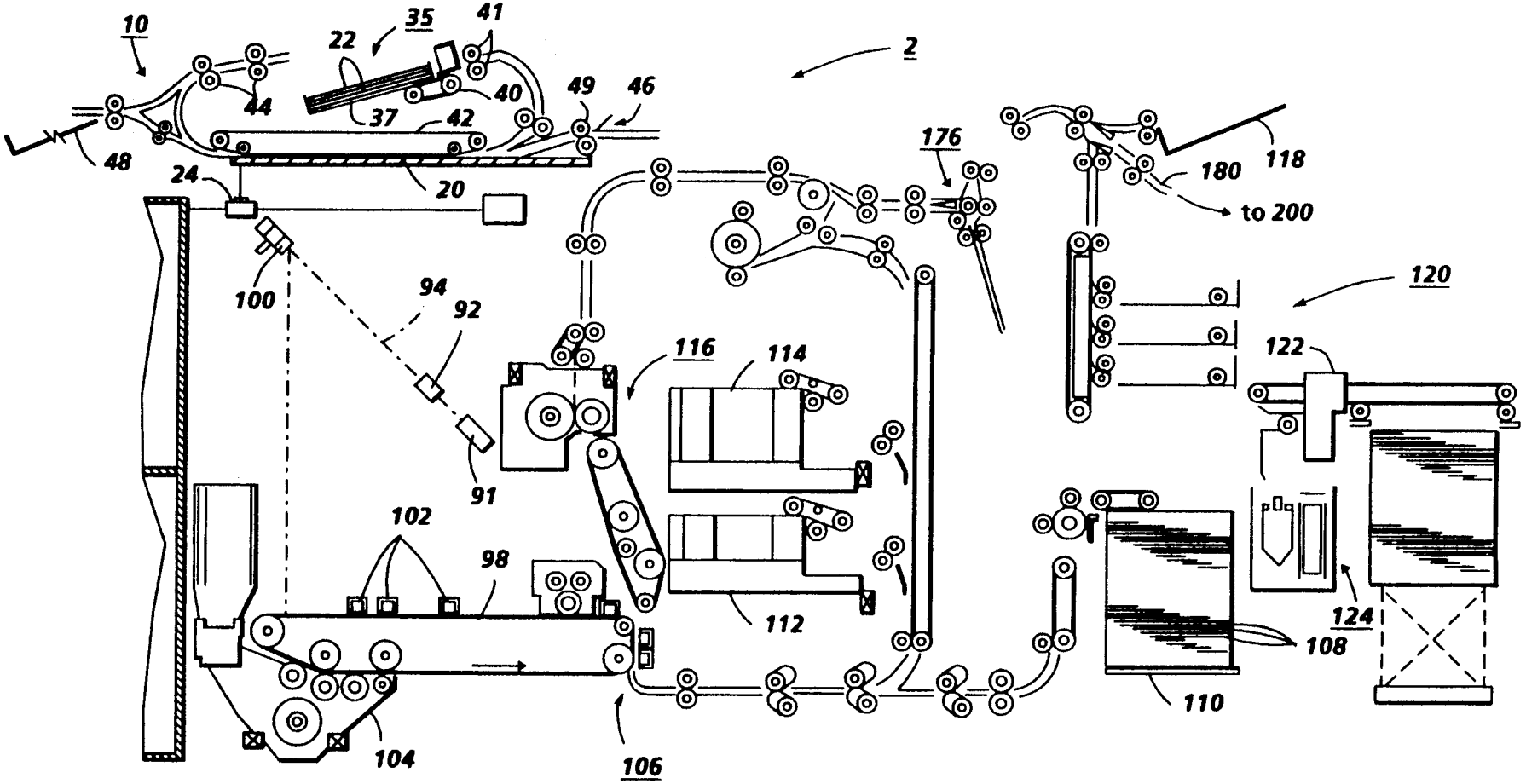
FIG. 3 is a plan view illustrating the principal mechanical components of the printing system shown in FIG. 1.
Figure 4:
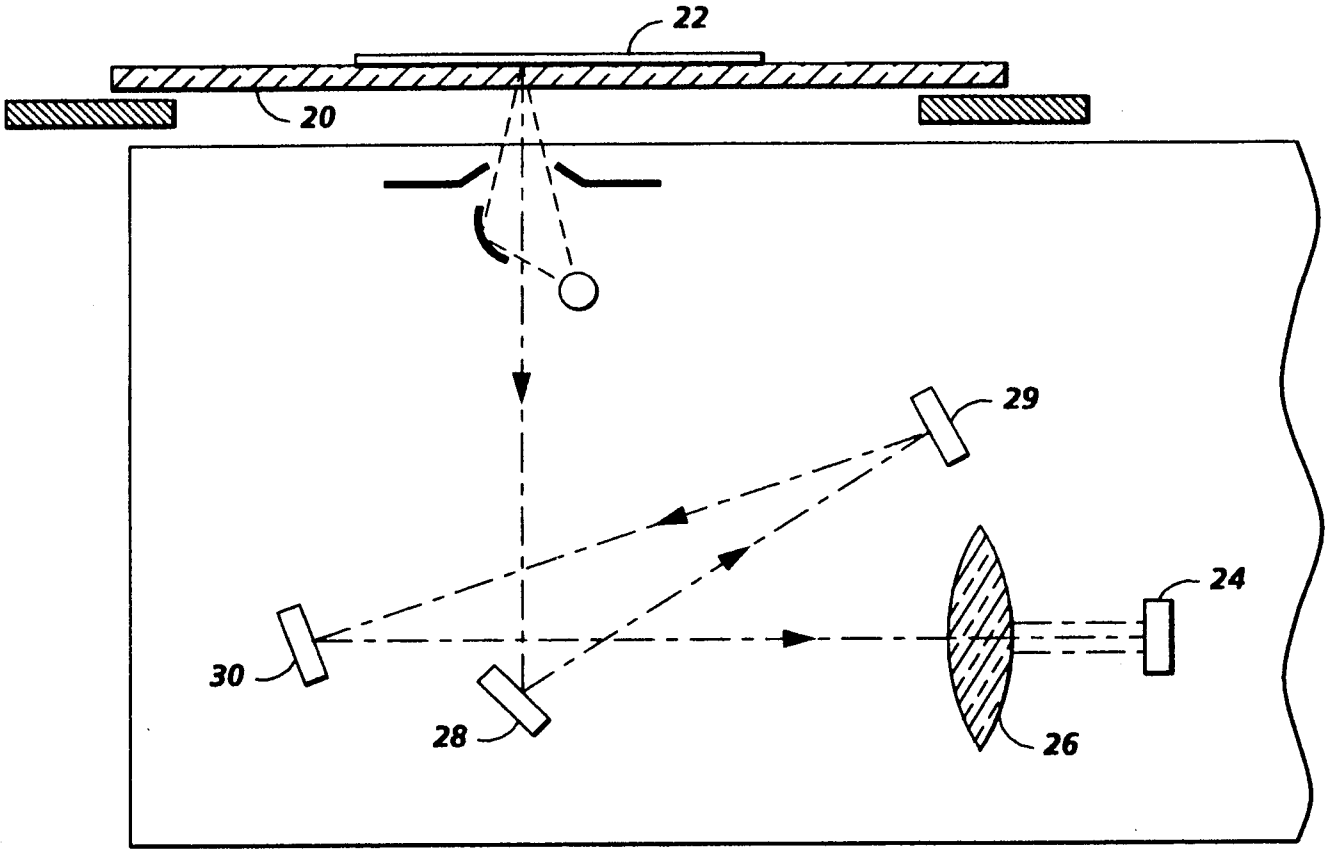
FIG. 4 is a schematic view showing certain construction details of the document scanner for the printing system shown in FIG. 1.

Referring particularly to FIGS. 2–4, scanner section 6 incorporates a transparent 20 on which the document 22 to be scanned is located. One or more linear arrays 24 are supported for reciprocating scanning movement below platen 20. Lens 26 and mirrors 28, 29, 30 cooperate to focus array 24 on a line like segment of platen 20 and the document being scanned thereon. Array 24 provides image signals or pixels representative of the image scanned which, after suitable processing by processor 25, are output to controller section 7.

Processor 25 converts the analog image signals output by array 24 to digital image signals and processes the image signals as required to enable system 2 to store and handle the image data in the form required to carry out the job programmed. Processor 25 also provides enhancements and changes to the image signals such as filtering, thresholding, screening, cropping, reduction-/enlarging, etc. Following any changes and adjustments in the job program, the document must be rescanned.

Documents 22 to be scanned may be located on platen 20 for scanning by automatic document handler (ADF) 35 operable in either a Recirculating Document Handling (RDH) mode or a Semi-Automatic Document Handling (SADH) mode. A manual mode including a Book mode and a Computer Forms Feeder (CFF) mode are also provided, the latter to accommodate documents in the form of computer fanfold. For RDH mode operation, document handler 35 has a document tray 37 in which documents 22 are arranged in stacks or batches. The documents 22 in tray 37 are advanced by vacuum feed belt 42 onto platen 20 where the document is scanned by array 24. Following scanning, the document is removed from platen 20 and discharged into catch tray 48.

For operation in the CFF mode, computer forms material is fed through slot 46 and advanced by feed rolls 49 to document feed belt 42 which in turn advances a page of the fanfold material into position on platen 20.

Referring to FIGS. 2 and 3, printer section 8 comprises a laser type printer and, for purposes of explanation, is separated into a Raster Output Scanner (ROS) section 87, Print Module Section 95, Paper Supply Section 107, and High Speed Finisher 120. ROS 87 has a laser 90, the beam of which is split into two imaging beams 94. Each beam 94 is modulated in accordance with the content of an image signal input by acousto-optic modulator 92 to provide dual imaging beams 94. Beams 94 are scanned across a moving photoreceptor 98 of Print Module 95 by the mirrored facets of a rotating polygon 100 to expose two image lines on photoreceptor 98 with each scan and create the latent electrostatic images represented by the image signal input to modulator 92. Photoreceptor 98 is uniformly charged by corotrons 102 at a charging station preparatory to exposure by imaging beams 94. The latent electrostatic images are developed by developer 104 and transferred at transfer station 106 to a print media 108 delivered by Paper Supply section 107. Media 108 as will appear may comprise any of a variety of sheet sizes, types, and colors. For transfer, the print media is brought forward in timed registration with the developed image on photoreceptor 98 from either a main paper tray 110 or from auxiliary paper trays 112, or 114. The developed image transferred to the print media 108 is permanently fixed or fused by fuser 116 and the resulting prints discharged to either output tray 118, to high speed finisher 120, or through bypass 180 to some other downstream finishing device, which could be a low speed finishing device such as an SBM 200. High speed finisher 120 includes a stitcher 122 for stitching or stapling the prints together to form books and thermal binder 124 for adhesively binding the prints into books.

Referring to FIGS. 1, 2 and 5, controller section 7 is, for explanation purposes, divided into an image input controller 50, User Interface(UI) 52, system controller 54, main memory 56, image manipulation section 58, and image output controller 60.

The scanned image data input from processor 25 of scanner section 6 to controller section 7 is compressed by image compressor/processor 51 of image output input controller 50 on PWB 70-3. As the image data passes through compressor/processor 51, it is segmented into slices N scanlines wide, each slice having a slice pointer. The compressed image data together with slice pointers and any related image descriptors providing image specific information (such as height and width of the document in pixels, the compression method used, pointers to the compressed image data, and pointers to the image slice pointers) are placed in an image file. The image files, which represent different print jobs, are temporarily stored in system memory 61 which comprises a Random Access Memory or RAM pending transfer to main memory 56 where the data is held pending use.

As best seen in FIG. 1, UI 52 includes a combined operator controller/CRT display consisting of an interactive touchscreen 62, keyboard 64, and mouse 66. UI 52 interfaces the operator with printing system 2, enabling the operator to program print jobs and other instructions, to obtain system operating information, instructions, programming information, diagnostic information, etc. Items displayed on touchsceen 62 such as files and icons are actuated by either touching the displayed item on screen 62 with a finger or by using mouse 66 to point a cursor to the item selected and keying the mouse.

Main memory 56 has plural hard 90-1, 90-2, 90-3 for storing machine Operating System software, machine operating data, and the scanned image data currently being processed.

When the compressed image data in main memory 56 requires further processing, or is required for display on touchscreen 62 of UI 52, or is required by printer section 8, the data is accessed in main memory 56. Where further processing other than that provided by processor 25 is required, the data is transferred to image manipulation section 58 on PWB 70-6 where the additional processing steps such as collation, make ready, decomposition, etc. are carried out. Following processing, the data may be returned to main memory 56, sent to UI 52 for display on touchscreen 62, or sent to image output controller 60.

Figure 5A:
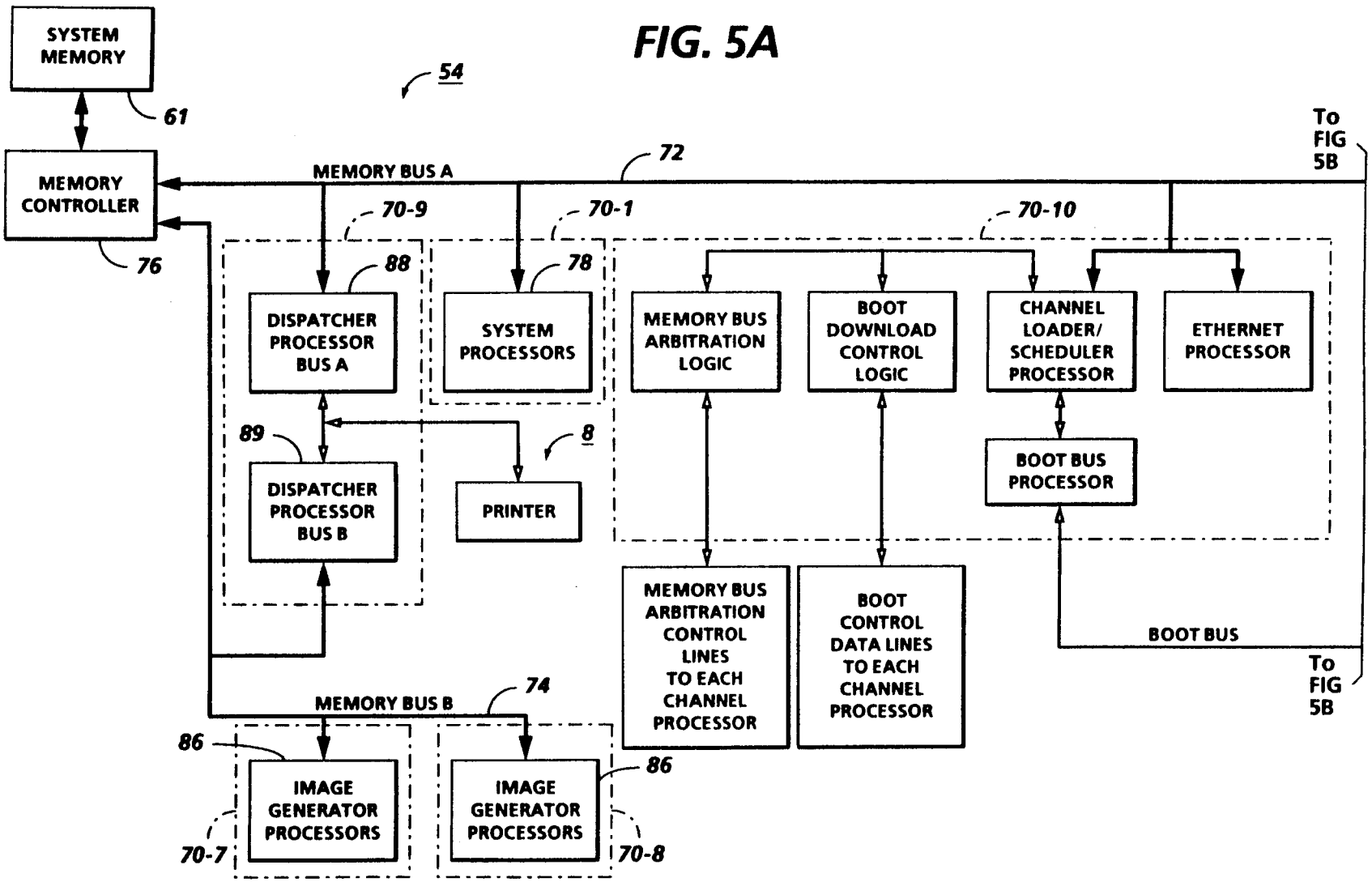
FIGS. 5A–5C comprise a schematic block diagram showing the major parts of the control section for the printing system shown in FIG. 1.

Image data output to image output controller 60 is decompressed and readied for printing by image generating processors 86 of PWBs 70-7, 70-8 (seen FIG. 5A). Following this, the data is output by dispatch processors 88, 89 on PWB 70-9 to printer section 8. Image data sent to printer section 8 for printing is normally purged from memory 56 to make room for new image data.

Figure 5B:
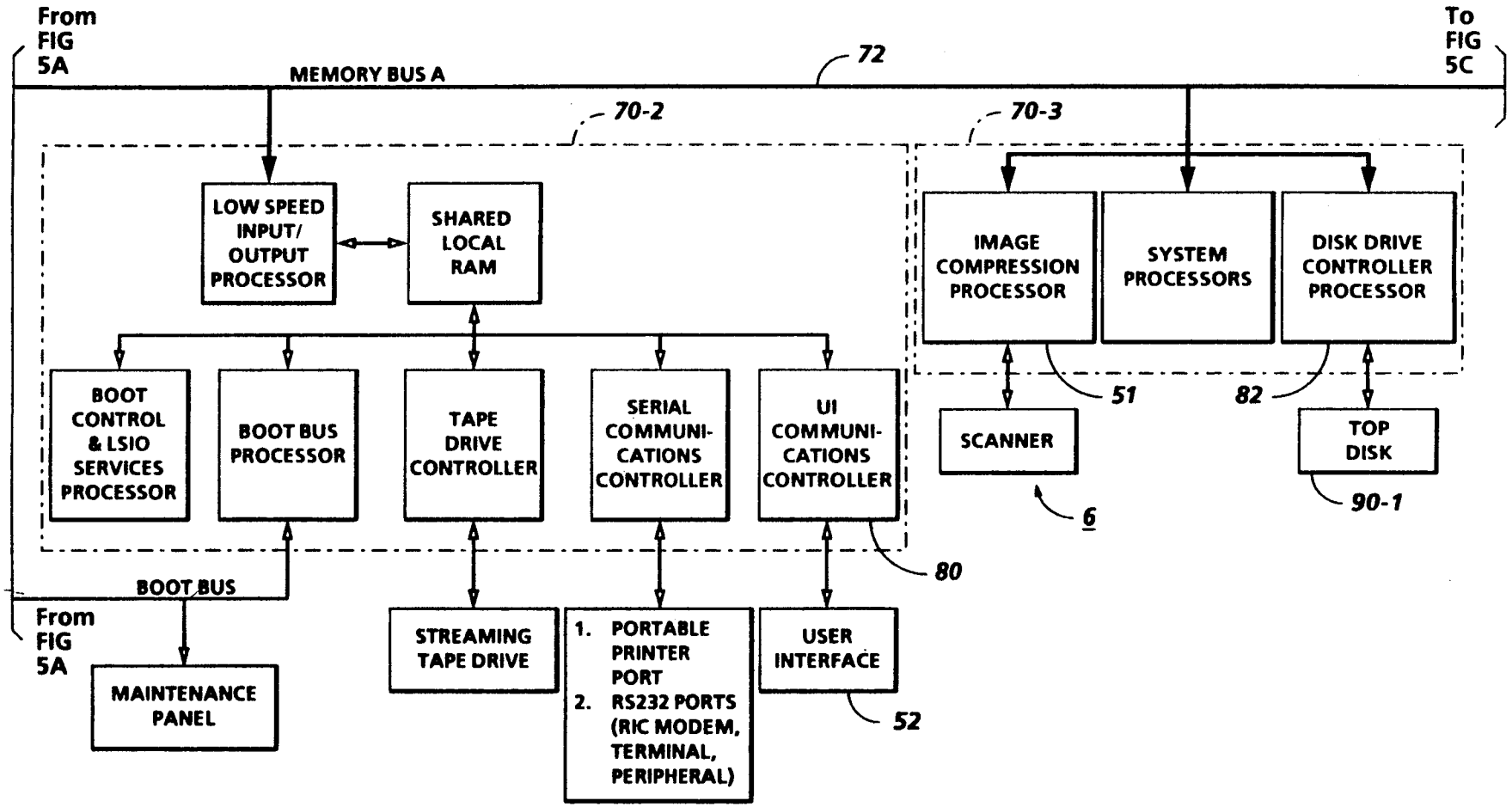
Figure 5C:
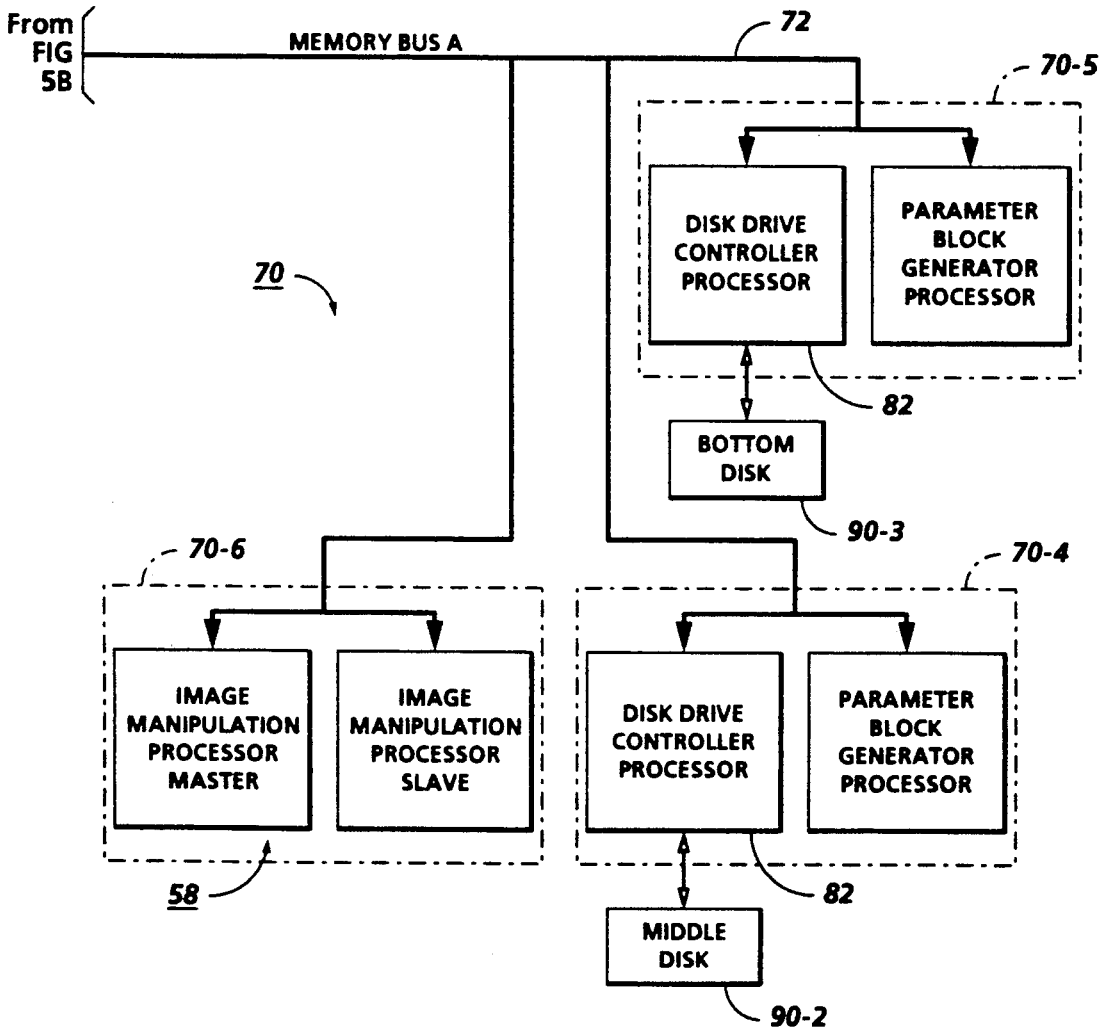

Referring particularly to FIGS. 5A-5C, control section 7 includes a plurality of Printed Wiring Boards (PWBs) 70, PWBs 70 being coupled with one another and with System Memory 61 by a pair of memory buses 72, 74. Memory controller 76 couples System Memory 61 with buses 72, 74. PWBs include system processor PWB 70-1 having plural system processors 78; low speed I/0 processor PWB 70-2 having UI communication controller 80 for transmitting data to and from UI 52; PWBs 70-3, 70-4, 70-5 having disk drive controller/processors 82 for transmitting data to and from disks 90-1, 90-2, 90-3 respectively of main memory 56 (image compressor/processor 51 for compressing the image data is on PWB 70-3); image manipulation PWB 70-6 with image manipulation processors of image manipulation section 58; image generation processor PWBs 70-7, 70-8 with image generation processors 86 for processing the image data for printing by printing section 8; dispatch processor PWB 70-9 having dispatch processors 88, 89 for controlling transmission of data to and from printer section 8; and boot control-arbitration-scheduler PWB 70-10.

Figure 6:
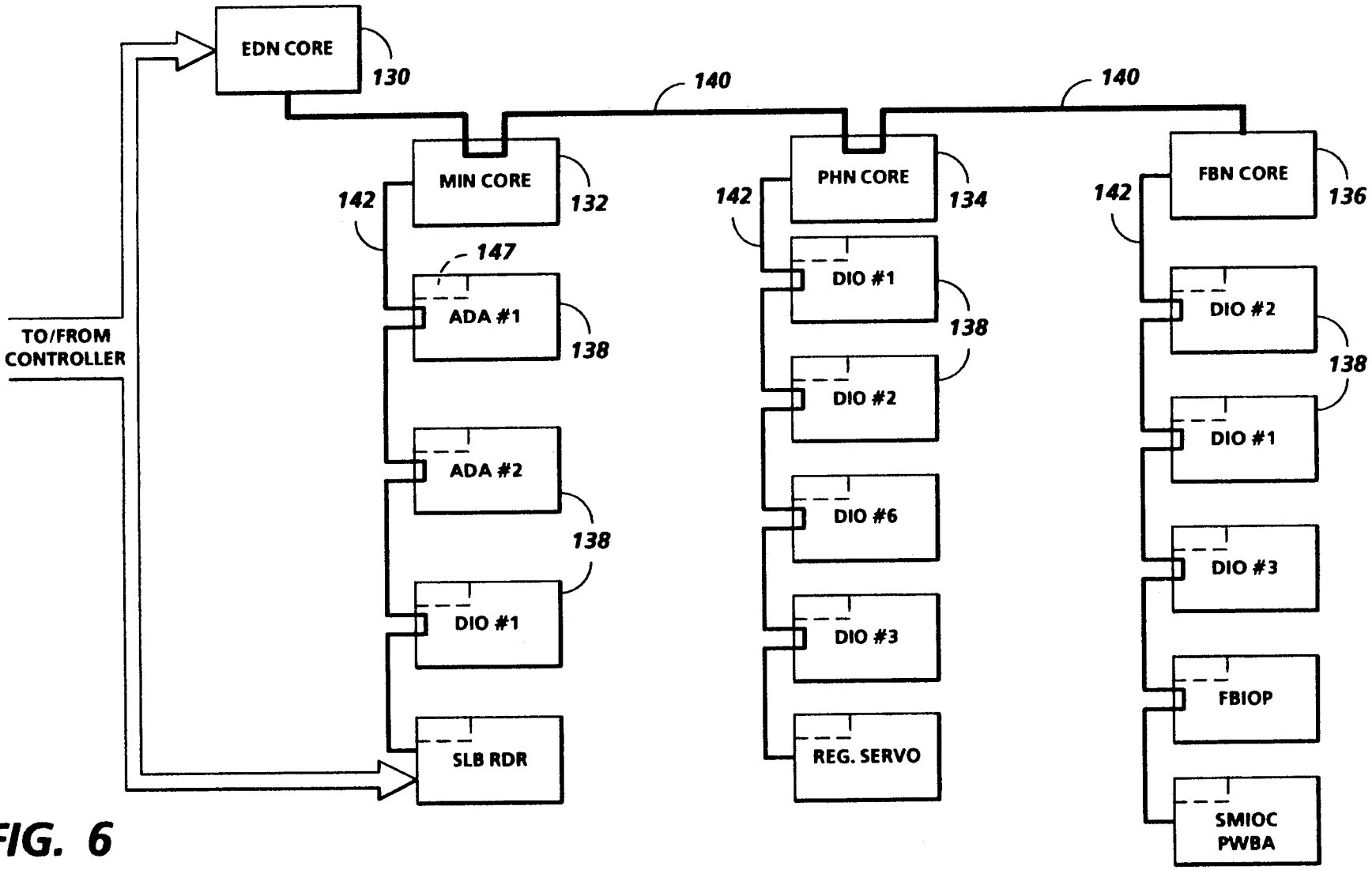
FIG. 6 is a block diagram of the Operating System, together with Printed Wiring Boards and shared line connections for the printing system shown in FIG. 1.

Referring particularly to FIG. 6, system control signals are distributed via a plurality of printed wiring boards (PWBs). These include EDN (electronic data node) core PWB 130, Marking Imaging core PWB 132, Paper Handling core PWB 134, and Finisher Binder core PBW 136 together with various Input/Output (I/0) PWBs 138. A system bus 140 couples the core PWBs 130, 132, 134, 136 with each other and with controller section 7 while local buses 142 serve to couple the I/0 PWBs 138 with each other and with their associated core PWB.

A Stepper Motor Input Output Controller (SMIOC) Printed Wiring Board Assembly (PWBA) is included when the printing system is used with an SBM. The SMIOC PWBA controls the operation of a sheet rotator which may be required when using the SBM. The SMIOC PWBA also handles the exporting of control signals from the printer to the SBM and monitors the status lines from the SBM. The SBM has two status lines whose status is either high or low. The status lines respectively indicate whether the SBM is ready and whether the SBM (output stacking tray) is full.

On machine power up, the Operating System software is loaded from memory 56 to EDN core PWB 130 and from there to remaining core PWBs 132, 134, 136 via bus 140, each core PWB 130, 132, 134, 136 having a boot ROM 147 for controlling downloading of Operating System software to PWB, fault detection, etc. Boot ROMs 147 also enable transmission of Operating System software and control data to and from PWBs 130, 132, 134, 136 via bus 140 and control data to and from I/0 PWBs 138 via local buses 142. Additional ROM, RAM, and NVM memory types are resident at various locations within system 2.

Figure 7:
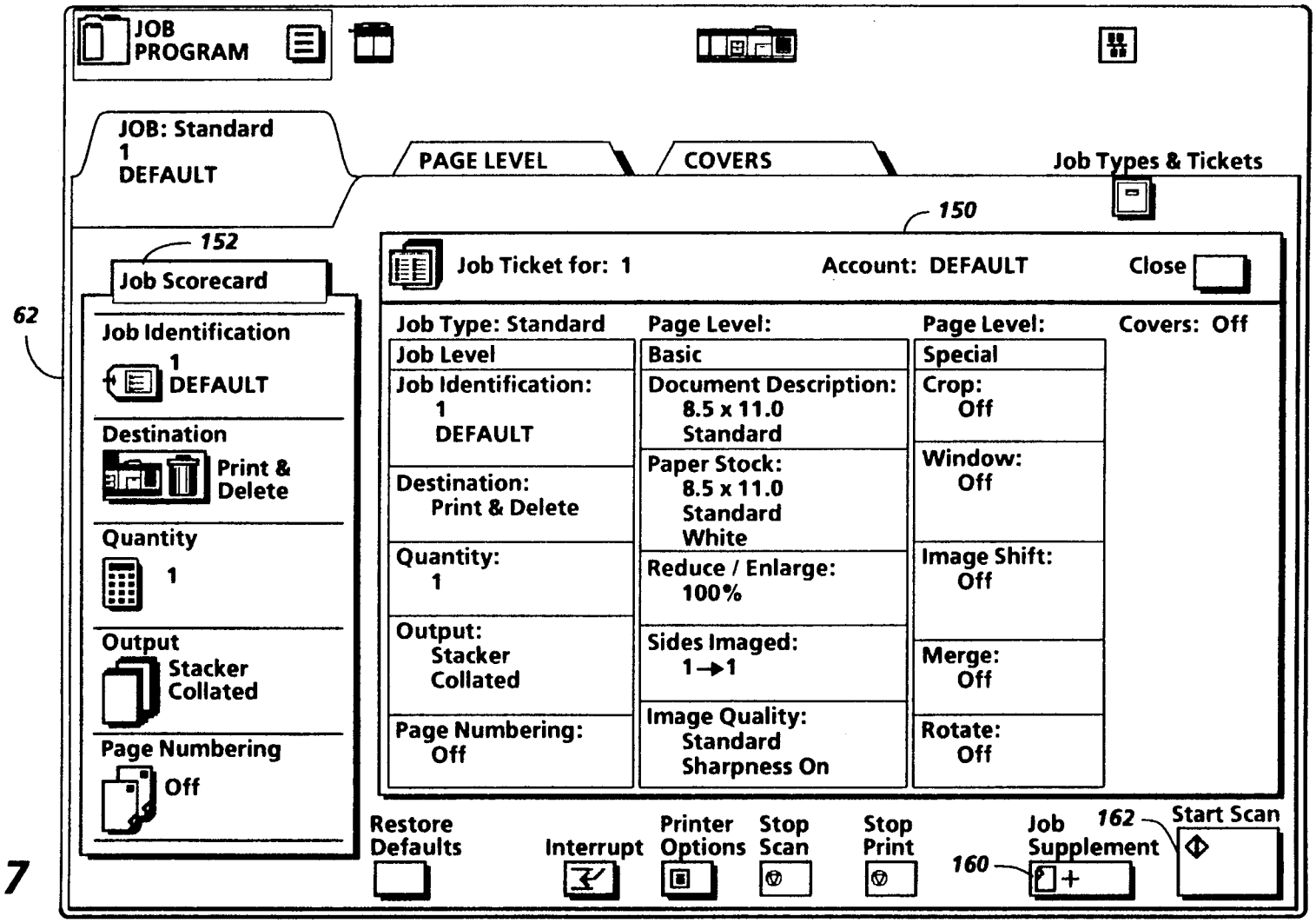
FIG. 7 is a view depicting an exemplary job programming ticket and job scorecard displayed on the User Interface(UI) touchscreen of the printing system shown in FIG. 1.

Referring to FIG. 7, jobs are programmed in a Job Program mode in which there is displayed on touchscreen 62 a Job Ticket 150 and a Job Scorecard 152 for the job being programmed. Job Ticket 150 displays various job selections programmed while Job Scorecard 152 displays the basic instructions to the system for printing the job.

B. The Duplex Paper Path Endless Loop

Figure 8:
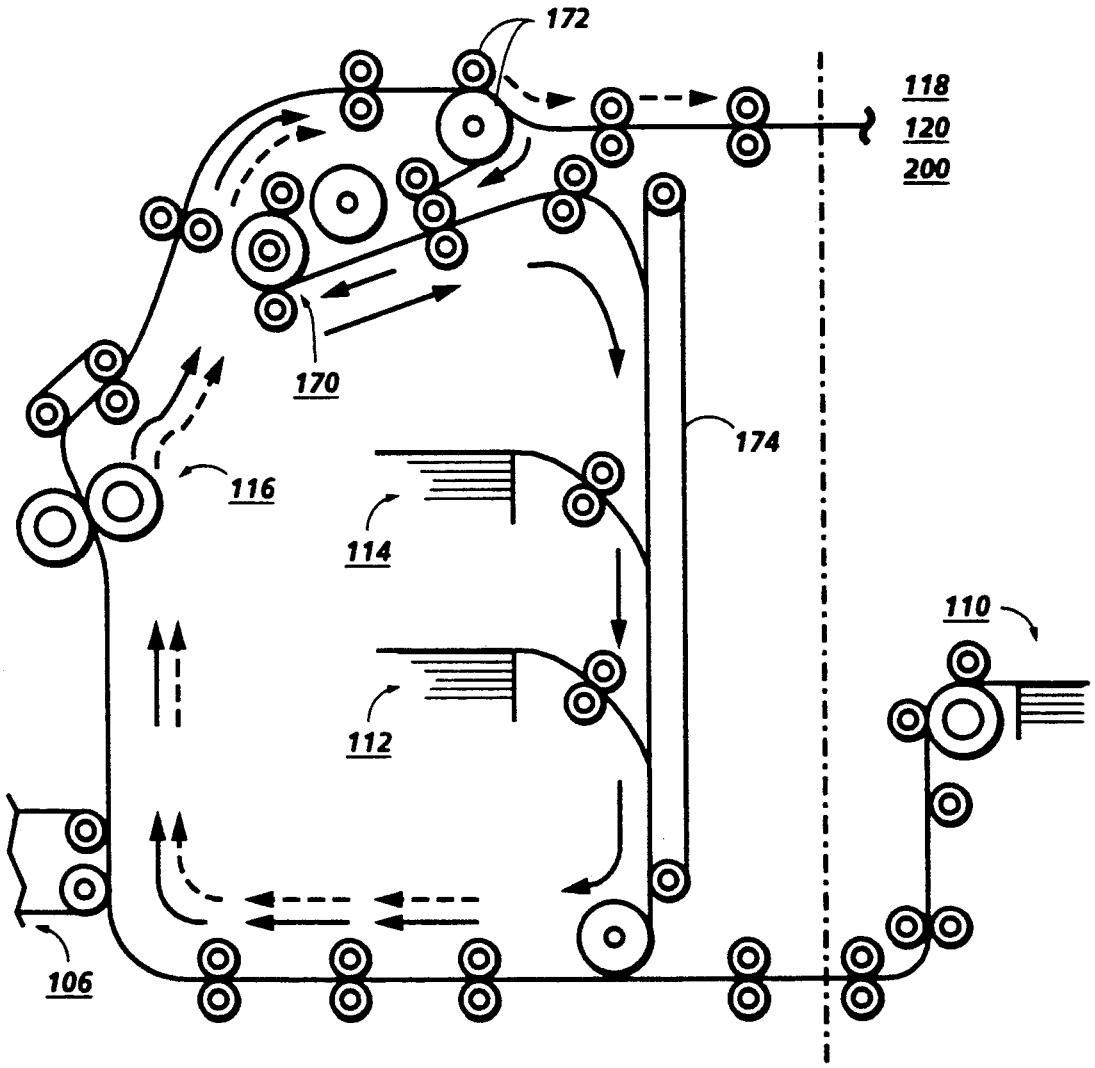
FIG. 8 is a plan view illustrating the duplex and simplex paper paths through which sheets are conveyed through the system of FIG. 3.

FIG. 8 is a plan view illustrating the duplex and simplex paper paths through which sheets are conveyed in the system of FIG. 3. In FIG. 8, the path through which a sheet travels during duplex imaging is illustrated by the arrowed solid lines, whereas the path through which a sheet to be simplex imaged travels is illustrated by the arrowed broken lines. After an appropriately sized sheet is supplied from one of feed trays 110, 112 or 114, the sheet is conveyed past image transfer station 106 to receive an image. The sheet then passes through fuser 116 where the image is permanently fixed or fused to the sheet. After passing through rollers 172, gates (not shown) either allow the sheet to move directly to a final destination (e.g., tray 118, high speed finisher 120, SBM 200), or deflects the sheet into single sheet inverter 170. If the sheet is either a simplex sheet or a duplex sheet having completed side one and side two images formed thereon, the sheet will be conveyed directly to its final destination. If the sheet is a duplex sheet printed only with a side one image, the gate will deflect the sheet into inverter 170, where the sheet will be inverted and then fed to belt 174 for recirculation past transfer station 106 and fuser 116 for receiving and permanently fixing the side two image to the backside of the sheet. Examples of single sheet inverters usable with the present invention are disclosed in U.S. Pat. No. 4,918,490; 4,935,786; 4,934,681; and 4,453,841, the disclosures of which are herein incorporated by reference.

Unlike some previously designed duplex paper feed paths, the illustrated embodiment includes a single sheet inverter and no duplex buffer tray. For a given paper path length, the duplex paper path architecture of the illustrated embodiment offers a shorter duplex loop time because there is no sheet settling time nor sheet reacquisition time which is typically required with duplex architectures having a buffer tray therein. The absence of sheet buffering for the illustrated architecture decreases the size of the duplex sheet tracking buffers in the IOT control system and reduces the maximum number of duplex path purge sheets. By eliminating buffering and reacquisition of sheets, this architecture eliminates the job integrity problems associated with delayed detection of duplex tray multifeeds. That is, since systems having duplex buffer trays therein frequently lead to job integrity problems due to more than one sheet being unintentionally fed from the buffer tray at a time, the elimination of the buffer tray eliminates this problem. Additionally, since less sheets exist in the duplex paper path at a time than when a buffer tray is employed, the controller which controls the imaging process need keep track of fewer copy sheets at a time. The single sheet inverter and duplex paper path employed in the illustrated example is capable of handling sheet ranging in width from 8 to 17 inches and ranging in length from 10 to 14.33 inches.

As defined herein, the width of a sheet for purposes of the copy sheet paper path is the length of the edge of that sheet which is parallel to the direction in which copy sheets are fed through the paper path (the process direction). Thus, as will be described below, since smaller ($8\frac{1}{2}\times 11$ inch) sheets are fed with their long edge (the 11 inch edge) first, their "width" in the paper path is $8\frac{1}{2}$ inches. Since large she such as $11\times 17$ inch sheets are fed with their short edge (the 11 inch edge) first, their width in the paper path is 17 inches.

The control of all machine functions, including all sheet feeding, is, conventionally, by a machine controller. The controller is preferably a known programmable microprocessor system, as exemplified by extensive prior art, e.g., U.S. Pat. No. 4,475,156 and its references. Plural but interconnecting microprocessors may also be used at different locations. The controller conventionally controls all the machine steps and functions described herein, and others, including the operation of the document feeder, all the document and copy sheet deflectors or gates, the sheet feeder drives, the downstream finishing devices 120, 200 etc. As further taught in the references, the copier controller also conventionally provides for storage and comparison of the counts of the copy sheets, the number of copy documents recirculated in a document set, the desired number of copy sets and other selections and controls by the operator through the console or other panel of switches connected to the controller, etc. The controller is also programmed for time delays, jam correction, etc. Conventional path sensors or switches may be utilized to help keep track of the position of the documents and the copy sheets and the moving components of the apparatus by connection to the controller. In addition, the controller variably regulates the various positions of the gates depending upon which mode of operation is selected.

C. The Signature Booklet Maker

Figure 9:
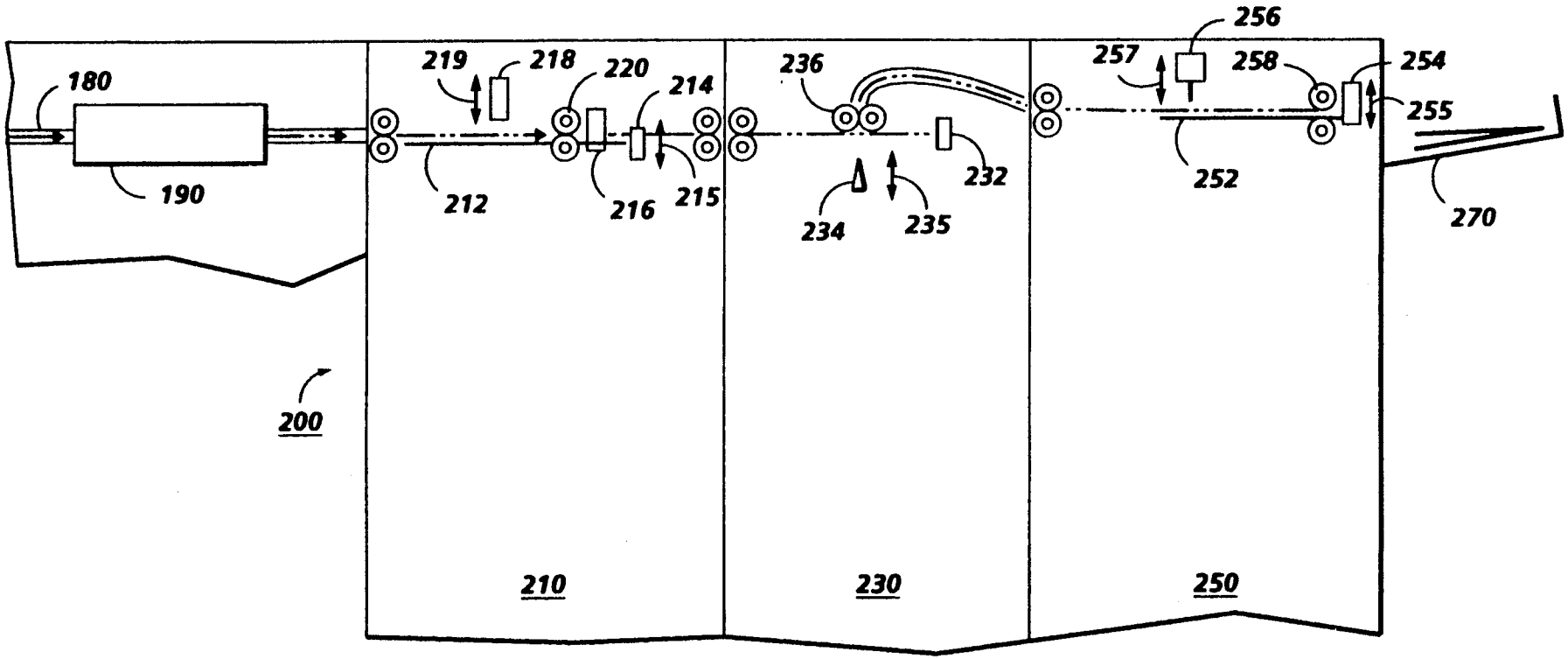
FIG. 9 is a schematic view of a Signature Booklet Maker for on-line use with the printing system of FIG. 1.

FIG. 9 is a schematic view of a Signature Booklet Maker for on-line use with the printing system of FIG. 1. The SBM 200 includes a saddle stitcher module 210, a folder module 230, and a trimmer module 150.

When large copy sheets ($11\times 17$ or A3) are signature printed, they are conveyed through and exit the duplex paper path short edge first, are fed through bypass 180 and into SBM 200 short edge first. When small copy sheets ($8\frac{1}{2}\times 11$ inch or A4) are signature printed, they are conveyed through and exit the duplex paper path long edge first and are fed through bypass 180. If these smaller sheets are to be folded across their long edge by the SBM, they must be rotated 90° prior to insertion into the SBM. Accordingly, a sheet rotary 190 is provided in the sheet bypass 180 for rotating sheets 90°.

Although a variety of well known rotators can be used, it is preferable to use a sheet rotator employing a single stepper motor which contacts one side of a sheet to selectively decrease the velocity of the that side (while a constant velocity roller-operating at the sheet bypass speed-engages and maintains the opposite side of the sheet at a constant velocity) to cause the sheet to rotate. Particularly, the sheet rotator disclosed in U.S. Pat. No. 5,090,683 to Venkatesh H. Kamath et al, filed Jul. 31, 1990 and entitled "Electronic Sheet Rotator With Deskew, Using Single Variable S Roller", the disclosure of which is incorporated herein by reference, can be used. The stepper motor is maintained at the constant sheet bypass velocity if it is not necessary to rotate the sheets. For example, it is also possible to feed $8\frac{1}{2}\times 11$ inch sheets into the SBM long edge first (without rotating) to form pamphlets having a final dimension (after folding) of $4\frac{1}{4}\times 11$ inches.

When the printing system of FIG. 1 is operated to produce signature booklets, the final destination of the signature-printed copy sheets output from the duplex paper path is the SBM 200. Accordingly, signature-printed copy sheets are deflected through sheet bypass 180 (rotated by sheet rotator 190 if necessary) and received by saddle stitcher 210. The copy sheets are received on a receiving tray 212 after entering stitcher 210 from sheet bypass 180. The forward movement of the sheets are stopped by a movable gate 214. Gate 214 moves in the direction indicated by line 215 to stop sheets, or permit the sheets to move downstream of saddle stitcher 210. When a booklet is to be formed from a plurality of signature-printed copy sheets, gate 214 remains in the position where it blocks the passage of copy sheets through saddle stitcher 210. Each sheet is stopped by gate 214, and then tapped by an aligner 216 to side register each sheet. The stopping and side registering of each $8\frac{1}{2}\times 11$ inch size sheet cannot be done at a rate as fast as the output of sheets from the duplex paper path when the printing system is operating in a burst mode.

After every copy sheet in a set of copy sheets is stopped by gate 214 and side aligned by aligner 216, stitchers 218 which move in the directing indicated by line 219, move downward to stitch al the signature printed copy sheets in the set to form a stitched booklet. Stitching can include, for example, stapling. After being stitched, the bound set of signature-printed copy sheets is forwarded to folder 230. In order to forward sheets out of saddle stitcher 210, gate 214 is moved so as to unblock the sheet passage out of saddle stitcher 210. Additionally, a sheet conveyor is contacted with the bound set to convey the set out of stitcher 210. The sheet conveyor can comprise, for example, a set of rollers 220 which are selectively movable toward and away from each other to engage and drive or disengage and not drive the set of copy sheets. For one example of a saddle stitcher, see U.S. Pat. No. 4,595,187 to Bober, the disclosure of which is incorporated herein by reference.

Folder 230 receives a set of bound signature-printed copy sheets, the forward motion of which is stopped by sheet stop 232. The set of bound signature-printed copy sheets is then folded by a sheet folder. One type of sheet folder can include a vertically movable folding bar 234 which contacts the signature sheets at a central location thereof (where the signature-printed copy sheets are stitched) and forces the central portion of the set of sheets between folding rollers 236. Folding rollers 236 fold the set of signature-printed copy sheets and convey the set out of folder 230 trimmer 250. For further details of folders using a folding bar and a pair of rollers see, for example, U.S. Pat. No. 4,905,977 to Vijuk, the disclosure of which is incorporated herein by reference. Of course, other types of folders such as those disclosed in U.S. Pat. No. 5,076,556 filed Jul. 1991 to Barry Mandel, the disclosure of which is incorporated herein by reference, can alternatively be used to place folds in sets of documents.

After being folded, the set of signature-printed copy sheets are received on tray 252 of trimmer 250. The forward movement of the folded signature-printed set is stopped by movable sheet stop 254 (which moves in the vertical direction indicated by line 255). After being stopped, the uneven edges of the folded signature set are trimmed by the cutting blade of trimmer 256 which moves in the vertical direction as indicated by line 257. After being trimmed, the folded signature set (or booklet) is fed by rollers 258 out of trimmer 250 and onto a tray 270 or other type of stacking unit. (The trimming operation is not required for all sets. That is, for example, smaller sized sets may not require trimming.)

It is understood that the location of the various sheet stops can be adjustable so that the SBM can form signature booklets from copy sheets having a variety of sizes. It is also understood that other types of stitchers, folders and trimmers can be used with the present invention to form signature booklets. The present invention is applicable to finishing devices other than SBMs, and generally to any on-line finishing device which operates at a frequency lower than a maximum operating frequency of the printing system with which it is integrated.

Additionally, the SBM modules can be modified to edge stitch standard (non-signature) jobs. Edge stitching is defined as placing one or more stitches along the short or long edge of a set (versus the saddle stitch position). To provide edge stitching with SBM equipment, the stitchers 218 are repositioned within the stitcher module and the folding and trimming modules are bypassed. The present invention of selectable duplex scheduling is applicable to this type of edge stitching since the same slow stitcher module is used.

D. Sheet Scheduling

According to the present invention, the manner in which sheets are scheduled for being printed in the printing system is controlled based upon a determination of which scheduling mode is most appropriate for the document finishing device located at the final destination of the printed copy sheets. When the copy sheets are output in sets, each copy sheet in a set has the same final destination. Accordingly, the scheduling determination is usually made based on the final destination of each set.

In particular, the printing system according to the present invention is capable of scheduling copy sheets for being printed in a first mode where the printed copy sheets are output from the copy sheet paper path of the printing system without any skipped pitches located between consecutively output copy sheets. This first mode of scheduling provides the maximum output (and thus productivity) of the printing system. However, as noted earlier, some finishing devices cannot receive copy sheets at as high a frequency as the copy sheets are output by the printing system when operating in this first mode. Accordingly, the present invention compares information known regarding the set to be printed with predetermined criteria, to operate the printing system in a first high productivity mode of scheduling if the finishing device at the final destination of the set of copy sheets can receive the copy sheets at the high rate at which they are output by the printing system, or to operate the printing system in a second, slower mode of scheduling if the output frequency of the first mode is too fast for the finishing device.

This second, slower mode of operation results in printed copy sheets being output from the printing system with skipped pitches located between at least some of the consecutively output copy sheets. When operating with the Signature Booklet Maker of FIG. 9, or, for example, any other device which includes a she receiving and aligning mechanism such as that disclosed in the saddle stitching module 210 of the SBM 200, skipped pitches are inserted between each consecutively output copy sheet. Thus, adequate time will exist between the output of each copy sheet for the saddle stitcher to receive and align each copy sheet. However, if the copy sheet receiving and aligning mechanism aligns a plurality of copy sheets at the same time (for example, by using a jogger which receives a plurality of copy sheets and then aligns the plurality of copy sheets at the same time), skipped pitches need only be inserted between some of the consecutively output copy sheets (the copy sheets between jogging operations) to provide time for the jogging operation to be performed.

Figure 10:
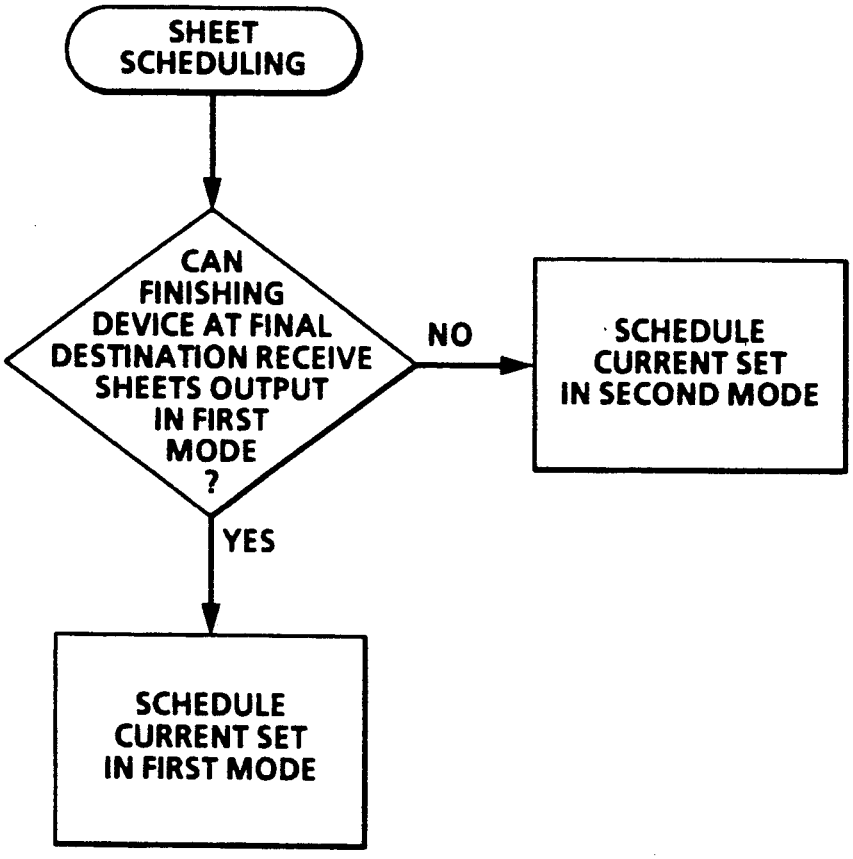
FIG. 10 is a high level flowchart of a scheduling procedure according to the present invention.

The basic procedure is illustrated in the flowchart of FIG. 10. The sheet scheduling function is performed by the EDN board 130 shown in FIG. 6. If the finishing device at the final destination of a set of copy sheets is capable of receiving the copy sheets output in the first mode, scheduling will be performed in that mode. Accordingly, if possible, scheduling will take place in the most productive mode of operation of the printing system. However, if the finishing device cannot receive copy sheets output in the first mode, the scheduling will be conducted in the second, slower mode of operation where skipped pitches are inserted between at least some of the copy sheets output from the printing system.

A specific example will now be provided of the present invention as applied to the printing system of FIG. 1 coupled to the SBM 200 of FIG. 9. It is highly desirable to operate finishing devices on-line with the printing systems which output printed copy sheets, because it reduces handling time and expense. For example, it is not atypical for printing systems to be operated separately from finishing devices to produce one or more large stacks of printed copy sheets. These large stacks of copy sheets then must be transferred (typically manually) to a feeding device which feeds the printed copy sheets to the SBM at its appropriate rate. If each module of the SBM is operated separately, the manual transfer of copy sets between each module is required. The manual handling of sets of copy sheets increases the operation time, reducing productivity. Additionally, the transfer of batches of copy sets between the printing system and the SBM, or between each module of the SBM, whether automatic or by hand, increases the probability of the copy sheet order being destroyed, for example, by dropping the batch of copy sheet sets. Additionally, off line operation of the SBM precludes automatic job recovery for SBM jams, and increases the risk of sheet damage or soiling due to manual handling and jogging.

As discussed earlier, the printing system of FIG. 1 includes a duplex paper path loop as a function of pitch mode for printing one or more images on both sides of copy sheets. The duplex paper path includes sheet inverter 170 which inverts side one printed copy sheets, and immediately conveys them back toward imaging station 106 to receive their side two image. Accordingly, the first, high productivity mode of the present invention corresponds to the previously described burst mode where copy sheets are inserted into and output from the duplex paper path without skipped pitches between consecutive copy sheets. The second, less productive mode corresponds to the previously described interleave mode of operation where copy sheets are inserted into and output from the duplex paper path loop with skipped pitches between each consecutive copy sheet.

The length (in pitches) of the duplex paper path loop varies according to the size of the copy sheets which are being printed thereon. Table 1 illustrates the length (in pitches) of the duplex paper path loop as a function of pitch mode for some conventional sizes of copy sheets which are printed. The duplex paper path loop size is eight pitches long in seven pitch mode and four pitches long in three pitch mode. The length of the duplex paper path is measured from the lead edge of a copy sheet at transfer to the lead edge of the inverted print at transfer. As can be seen, printing system 2 is selectively operable in one of a three pitch mode or a seven pitch mode.

TABLE 1

| SHEET SIZE | PITCH MODE | DUPLEX LOOP SIZE |
|---|---|---|
| 8½" × 11" | 7 | 8 |
| A4 | 7 | 8 |
| 11" × 17" | 3 | 4 |
| A3 | 3 | 4 |

Pitch mode is defined as the number of integral images placed on the photoreceptor. Pitch mode is a function of image width which is usually equal to paper width. Fundamentally the duplex loop size in pitches is a function of pitch time, paper width, the duplex loop length and velocities throughout the loop. Given a constant photoreceptor surface speed—necessary for a ROS based imaging system—the frequency of copy sheet deliveries is strictly a function of pitch mode. It is not a function of duplex loop size.

The printing system operates in the seven pitch mode unless 11×17 inch copy sheets or A3 size copy sheets are used. More generally, the printing system operates in seven pitch mode (where a length, M, of the duplex paper path loop is 8 pitches) when the width of copy sheets is equal to or less than 9.0 inches, and operates in three pitch mode (where M=4 pitches) when the copy sheet width is greater than 9.0 inches and less than or equal to 17 inches. Due to their length, eight 11×17 inch copy sheets cannot be carried in the duplex paper path loop at one time. Accordingly, when using 11×17 inch copy sheets, the printing system operates in the three pitch mode. Although no skipped pitches are inserted between the 11×17 inch copy sheets, their output from the printing system is three-sevenths that of smaller sheets when the printing system is operating in the burst mode. Thus, in the present example, the SBM 200 can receive 11×17 inch (or A3 size) copy sheets output from the printing system in burst mode.

Figure 11:
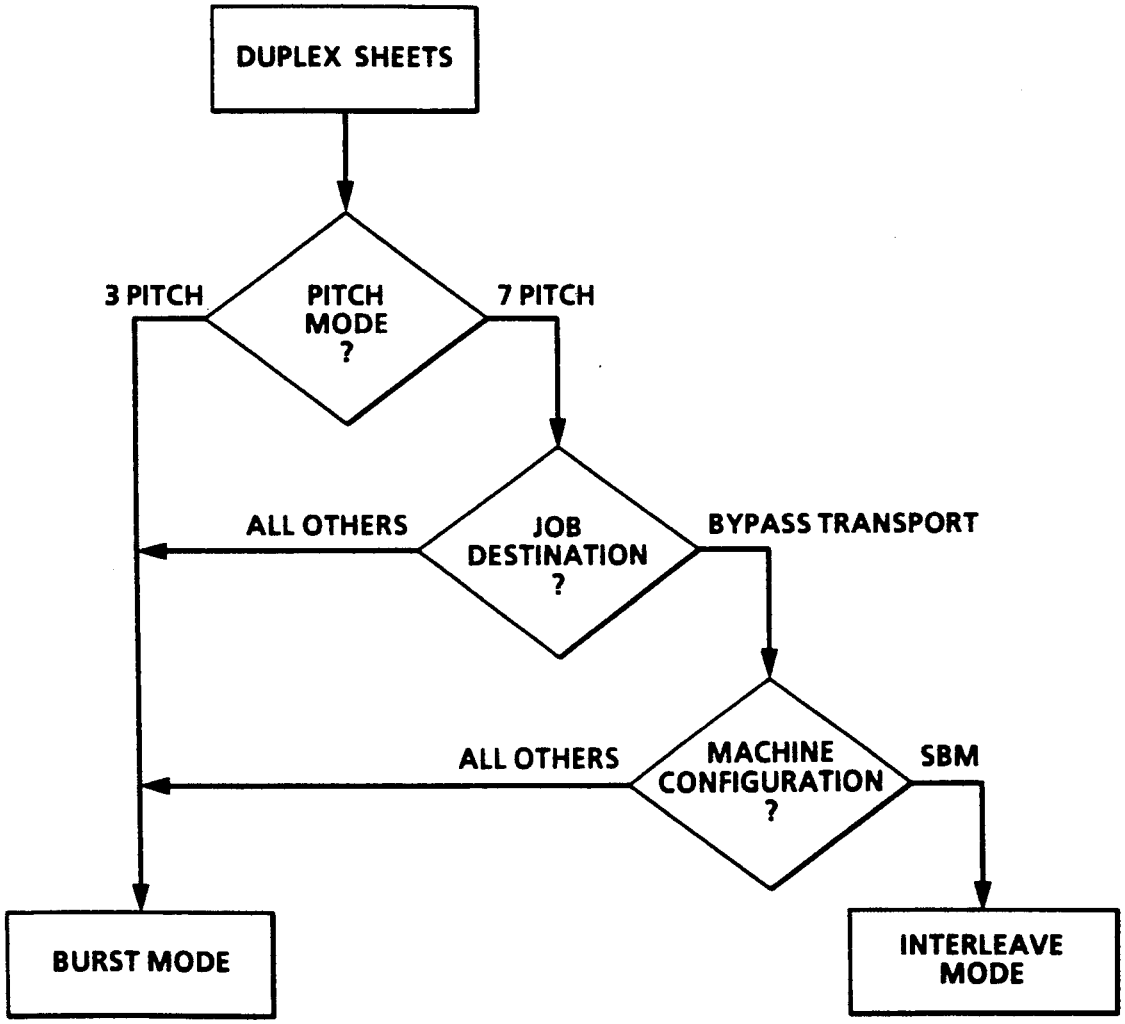
FIG. 11 is a flowchart illustrating the application of the present invention to the printing system of FIG. 1 combined with the SBM of FIG. 9.

Accordingly, as illustrated in the flowchart of FIG. 11, the pitch mode in which the printing system is operated is another factor to be considered when determining whether to operate in the burst or interleave mode. If the system operates in the three pitch mode, copy sheets will be scheduled in the burst mode. However, if the printing system operates in the seven pitch mode, it may necessary to schedule sheets in the interleave mode. Accordingly, as illustrated in FIG. 11, if the printing system is operating in the seven pitch mode and the final destination of the copy sheets is the SBM, the printing system will operate in the interleave mode as described above.

If the only finishing device attached to bypass transport 180 is the SBM, the determinations described above are the only ones that need to be made in determining whether to schedule in the burst or the interleave modes. However, as illustrated in FIG. 11, if bypass transport 180 is connected to a plurality of different finishing devices, three determinations need to be made. These determinations include:

a) determining whether copy sheets are being scheduled in the three or the seven pitch mode;

b) determining whether the job destination of the set of printed copy sheets is bypass transport 180; and c) determining the machine configuration currently enabled at the bypass transport.

For example, the bypass transport 180 can include a gate which selectively feeds the sets of copy sheets to one of a plurality of machine configurations. Since only the SBM is incapable of receiving copy sheets at the full 135 per minute rate, in the above example, the SBM is the only machine configuration which requires the interleave mode to be used in the printing system.

When printing multiple sets of copy sheets which contain at least some duplex printed copy sheets in burst mode or interleave mode, in certain situations, it is possible to intermix the copy sheets from different sets or jobs as long as the order in which the sets are output from the duplex paper path (and the final destinations of each set) does not result in the printed sets being intermixed. A number of scheduling algorithms for increasing printer productivity by intermixing copy sheets are disclosed in the incorporated U.S. Pat. No. 5,095,342. The algorithms disclosed in U.S. Pat. No. 5,095,342 can be used to determine the order in which the copy sheets will be printed once inserted into the duplex paper path. Copy sheets are then inserted into the duplex paper path according to either a burst mode of operation or an interleave mode, based upon the criteria of the present invention. The burst mode algorithms are easily adapted to interleave mode by introducing one additional constraint on pitch availability at the insertion station where the copy sheets are inserted into the duplex paper path a pitch of the duplex paper path is unavailable (to receive a new copy sheet from a copy sheet supply bin) if a side one duplex, or a simplex sheet was scheduled in a preceding pitch. This results in new copy sheets being inserted on every other pitch.

The present invention is applicable to burst mode or interleave mode scheduling performed as described above, or using other logic which results in similar copy sheet output (no skipped pitches between consecutively output copy sheets, or a skipped pitch between each consecutively output sheet).

Table 2 illustrates burst versus interleave duplex scheduling for the initial portion of a three sheet duplex job (which is printed multiple times) on a printer with an eight pitch endless duplex paper path loop. The scheduling also illustrates a three pitch end-of-set dwell between each copy sheet set for permitting the SBM to sufficiently clear itself prior to receiving copy sheets from a subsequent set.

TABLE 2

| Pitch | Burst Mode | Interleave Mode |
|---|---|---|
| 1 | Set 1, Sheet 1, Side 1 | Set 1, Sheet 1, Side 1 |
| 2 | Set 1, Sheet 2, Side 1 | |
| 3 | Set 1, Sheet 3, Side 1 | Set 1, Sheet 2, Side 1 |
| 4 | | |
| 5 | | Set 1, Sheet 3, Side 1 |
| 6 | | |
| 7 | Set 2, Sheet 1, Side 1 | |
| 8 | Set 2, Sheet 2, Side 1 | |
| 9 | Set 1, Sheet 1, Side 2 | Set 1, Sheet 1, Side 2 |
| 10 | Set 1, Sheet 2, Side 2 | Set 2, Sheet 1, Side 1 |
| 11 | Set 1, Sheet 3, Side 2 | Set 1, Sheet 2, Side 2 |
| 12 | Set 2, Sheet 3, Side 1 | Set 2, Sheet 2, Side 1 |
| 13 | | Set 1, Sheet 3, Side 2 |
| 14 | | Set 2, Sheet 3, Side 1 |
| 15 | Set 2, Sheet 1, Side 2 | |
| 16 | Set 2, Sheet 2, Side 2 | |
| 17 | Set 3, Sheet 1, Side 1 | |
| 18 | Set 3, Sheet 2, Side 1 | Set 2, Sheet 1, Side 2 |
| 19 | Set 3, Sheet 3, Side 1 | Set 3, Sheet 1, Side 1 |
| 20 | Set 2, Sheet 3, Side 2 | Set 2, Sheet 2, Side 2 |
| 21 | | Set 3, Sheet 2, Side 1 |

TABLE 2-continued

| Pitch | Burst Mode | Interleave Mode |
|---|---|---|
| 22 | | Set 2, Sheet 3, Side 2 |
| 23 | Set 4, Sheet 1, Side 1 | Set 3, Sheet 3, Side 1 |
| 24 | Set 4, Sheet 2, Side 1 | |
| 25 | Set 3, Sheet 1, Side 2 | |
| 26 | Set 3, Sheet 2, Side 2 | |
| 27 | Set 3, Sheet 3, Side 2 | Set 3, Sheet 1, Side 2 |
| 28 | Set 4, Sheet 3, Side 1 | Set 4, Sheet 1, Side 2 |
| 29 | | Set 3, Sheet 2, Side 2 |
| 30 | | Set 4, Sheet 2, Side 1 |
| 31 | Set 4, Sheet 1, Side 2 | Set 3, Sheet 3, Side 2 |

As demonstrated in Table 2, the interleave mode does not output the final copy sheet in set one until pitch 13, whereas the burst mode outputs this copy sheet in pitch 11 and thus is more productive than the interleave mode. However, since the SBM is only capable of receiving sheets at the slower interleave mode rate, the SBM 200 can be operated on-line with printing system 2 when scheduling sheets in the interleave mode. Moreover, the ability to select between burst and interleave modes permits the printing system to operate in its most productive mode when possible.

One would not generally provide the interleave mode of operation as an option on a printing system which receives electronically manipulatable pages because the copy sheet paper path does not need to be synchronized with an original document handler, and because the burst mode is more productive for printers configured with an endless loop duplex paper path as described above. For printers configured with a buffering tray, e.g., XEROX 5700, interleave scheduling operation has no productivity penalty when filling the buffer tray because this can be done without skipped pitches. Additionally, since the skipped pitches created in the duplex loop when side one imaged sheets are fed from the buffer tray into alternating pitches on the duplex paper path for side two images, can be filled with copy sheets from the supply tray, the only productivity losses occur when there are no more copy sheets to be input to the duplex paper path from a supply tray.

While the present invention is described with reference to a particular embodiment, this embodiment is intended to be illustrative, not limiting. For example, the present invention can be used in any situation where some downstream finishing devices do not operate at as high a frequency as an upstream printing system. The present invention can also be used in connection with duplex printers which use a buffer tray in the duplex paper path loop. In such a buffer tray system, copy sheets could be inserted into the duplex loop without skipped pitches because after side one imaging the copy sheets are collected in the buffer tray. In order to provide skipped pitches between duplex copy sheets output from the printing system with images on both sides, the one side imaged copy sheets would be output from the buffer tray (and consequently from the duplex loop) with the appropriate skipped pitches between at least some of the consecutively output copy sheets. Various modifications may be made without departing from the spirit and scope of the invention as defined in the appended claims.

What is claimed is:

1. A method of scheduling copy sheets for being duplex printed, comprising the steps of:

inserting said copy sheets into a duplex paper path loop of an image forming apparatus, said duplex paper path loop having a plurality of pitches, each pitch corresponding to a length of said duplex paper path loop capable of being occupied by a single copy sheet;

forming images on each side of said copy sheets;

outputting said copy sheets from said duplex paper path loop toward a final destination; and wherein said scheduling is selectively conducted in one of a burst mode, where said copy sheets are consecutively inserted into said duplex paper path loop from a main storage tray for duplex printing without skipping any pitches in the duplex paper path loop between consecutively inserted copy sheets, and an interleave mode, where said copy sheets are inserted into said duplex paper path loop from the main storage tray for duplex printing with skipped pitches in said duplex paper path loop between at least some of the consecutively inserted copy sheets.

2. The method of claim 7, wherein a skipped pitch is inserted between each consecutively inserted copy sheet when scheduling is conducted in said interleave mode.

3. The method of claim 1, wherein said duplex paper path loop is an endless, buffer tray-less duplex paper path loop providing a plural copy sheet capacity duplexing path equal to M pitches, a value of M varying based upon a size of said copy sheets, said duplex paper path loop including an imaging station for forming images on said copy sheets, and a sheet inverter for inverting copy sheets having images formed on one side by said imaging station and immediately conveying said side-one-imaged copy sheets toward said imaging station for side two imaging.

4. The method of claim 1, wherein said image forming step includes forming two page images on each side of each copy sheet, so that said copy sheets are signatures which can be folded in half to form a booklet.

5. A method of scheduling copy sheets for being duplex printed, comprising the steps of:

inserting said copy sheets into a duplex paper path loop of an image forming apparatus, said duplex paper path loop having a plurality of pitches, each pitch corresponding to a length of said duplex paper path loop capable of being occupied by a single copy sheet;

forming images on each side of said copy sheets;

outputting said copy sheets from said duplex paper path loop toward a final destination; and wherein said scheduling is selectively conducted based upon at least said final destination, in one of a burst mode, where said copy sheets are consecutively inserted into said duplex paper path loop from a main storage tray for duplex printing without skipping any pitches in the duplex paper path loop between consecutively inserted copy sheets, and an interleave mode, where said copy sheets are inserted into said duplex paper path loop from the main storage tray for duplex printing with skipped pitches in said duplex paper path loop between at least some of the consecutively inserted copy sheets.

6. The method of claim 5, wherein said duplex paper path loop is an endless, buffer tray-less duplex paper path loop providing a plural copy sheet capacity duplexing path equal to M pitches, a value of M varying based upon a size of said copy sheets, said duplex paper path loop including an imaging station for forming images on said copy sheets, and a sheet inverter for inverting copy sheets having images formed on one side by said imaging station and immediately conveying said side-one-imaged copy sheets toward said imaging station for side two imaging.

7. The method of claim 5, wherein a skipped pitch is inserted between each consecutively inserted copy sheet when scheduling is conducted in said interleave mode.

8. The method of claim 7, wherein said duplex paper path loop is an endless, buffer tray-less duplex paper path loop providing a plural copy sheet capacity duplexing path equal to M pitches, a value of M varying based upon a size of said copy sheets so that said scheduling is selectively conducted in one of a plurality of different pitch modes, a value of M varying for each different pitch mode, said duplex paper path loop including an imaging station for forming images on said copy sheets, and a sheet inverter for inverting copy sheets having images formed on one side by said imaging station and immediately conveying said side-one-imaged copy sheets toward said imaging station for side two imaging.

9. The method of claim 8, wherein said scheduling is also selectively conducted in one of said burst mode and said interleave mode based upon the selected pitch mode.

10. The method of claim 9, wherein $M=8$ when a width of said copy sheets is equal to or less than 9.0 inches, $M=4$ when said width is greater than 9.0 inches and less than or equal to 17 inches, and said scheduling is conducted in said burst mode unless $M=8$.

11. The method of claim 10, wherein small copy sheets are fed through said duplex paper path long edge first when $M=8$, and large copy sheets are fed through said duplex paper path short edge first when $M=4$.

12. The method of claim 9, wherein said copy sheets are scheduled in said burst mode unless:

said image forming step includes forming two page images on each side of each copy sheet, so that said copy sheets are signatures containing two page images on each side; and said final destination is an on-line signature booklet maker which: receives and aligns consecutive sets of said signatures, each set defining a booklet; stitches each said aligned set of signatures to bind said set together; folds said bound set of signatures into a booklet; and trims edges of said booklet.

13. The method of claim 12, wherein $M=8$ when a width of said copy sheets is equal to or less than 9.0 inches, $M=4$ when said width is greater than 9.0 inches and less than or equal to 17 inches, and said scheduling is conducted in said burst mode unless $M=8$.

14. The method of claim 5, wherein said copy sheets are scheduled in said burst mode unless:

said image forming step includes forming two page images on each side of each copy sheet, so that said copy sheets are signatures containing two page images on each side; and said final destination is an on-line signature booklet maker which: receives and aligns consecutive sets of said signatures, each set defining a booklet; stitches each said aligned set of signatures to bind said set together; folds said bound set of signatures into a booklet; and trims edges of said booklet.

15. A method of scheduling sheets for printing and outputting collated sets of plural copy sheets, said copy sheets being output from a copy sheet paper path of an image forming apparatus, said copy sheet paper path having a length equal to at least one pitch wherein a pitch corresponds to a length of a copy sheet in a process direction of said copy sheet paper path, and including an insertion station where copy sheets are inserted into said paper path, an imaging station where an image is formed on a side of said copy sheets, and an output station where copy sheets having an image formed on at least one side are output from said copy sheet paper path, comprising the steps of:

inserting said copy sheets into said copy sheet paper path at said insertion station;

forming an image on at least one side of each copy sheet at said imaging station;

outputting said copy sheets from said copy sheet paper path at said output station toward a final destination; and wherein said scheduling is selectively conducted in one of a first mode, where for each set of copy sheets to be printed, said copy sheets are consecutively output from said copy sheet paper path without any skipped pitches between each output copy sheet, and a second mode, where for each set of copy sheets to be printed, said copy sheets are output from said copy sheet paper path with skipped pitches between at least some of said consecutively output copy sheets, whereby copy sheets are output from said copy sheet paper path at a lower frequency in said second mode than in said first mode.

16. The method of claim 15, wherein said scheduling is selectively conducted based on the final destination of each set of copy sheets.

17. The method of claim 16, wherein said scheduling is also selectively conducted based on a number of copy sheets which can be contained in said paper path at one time.

18. The method of claim 15, wherein a skipped pitch is inserted between each consecutively output copy sheet when scheduling is conducted in said second mode.

19. The method of claim 15, wherein said copy sheet paper path is an endless, buffer tray-less duplex paper path loop providing a plural copy sheet capacity duplexing path equal to M pitches, a value of M varying based upon a size of said copy sheets so that said scheduling is selectively conducted in one of a plurality of different pitch modes, a value of M varying for each different pitch mode, said duplex paper path loop also including a sheet inverter for inverting copy sheets having images formed on one side by said imaging station and immediately conveying said side-one-imaged sheets toward said imaging station for side two imaging, so that said image forming apparatus is capable of forming images on one or both sides of said copy sheets.

20. The method of claim 19, wherein when said image forming step includes forming two page images on each side of each copy sheet, so that said copy sheets are signatures which can be folded in half to form a booklet, said scheduling is conducted in said second mode.

21. The method of claim 19, wherein small copy sheets are fed through said duplex paper path long edge first when $M=8$, and large copy sheets are fed through said duplex paper path short edge first when $M=4$.

22. The method of claim 19, wherein said scheduling is selectively conducted in one of said first mode and said second mode based upon:

determining the final destination of each set of copy sheets; and determining the selected pitch mode, which determines the amount of time which passes between the output of each consecutive sheet from said duplex paper path loop.

23. A method of scheduling sheets for printing and outputting collated sets of plural copy sheets by an image forming apparatus, said image forming apparatus having a duplex paper path loop providing a plural copy sheet capacity duplexing path equal to M pitches, a value of M varying based upon the size of said copy sheets so that said scheduling is selectively conducted on one of a plurality of different pitch modes, a value of M varying for each different pitch mode, said duplex paper path loop including an insertion station for inserting copy sheets into said duplex paper path loop, an imaging station for forming images on a side of said copy sheets, a sheet inverter for inverting copy sheets having images formed on one side by said imaging station and conveying said side-one-imaged sheets toward said imaging station for side two imaging, and an output station for outputting copy sheets from said duplex paper path loop toward a final destination, said image forming apparatus being capable of outputting sheets containing one or more page images on one or both sides, said method comprising the steps of:

determining whether to con said scheduling in one of a burst mode, where for each set of copy sheets to be printed, said copy sheets are consecutively output from said duplex paper path loop without any skipped pitches between each output copy sheet, and an interleave mode, where for each set of copy sheets to be printed, said copy sheets are output from said duplex paper path loop with skipped pitches between at least some of said consecutively output copy sheets;

inserting copy sheets into said duplex paper path loop, forming one or more page images on one or both sides of said copy sheets based upon a predetermined print command, and outputting said copy sheets from said duplex paper path loop toward a final destination in one of said burst mode and said interleave mode based on said determining step; and wherein said determining step is based upon whether any on-line finishing devices located at the final destination of said copy sheet sets are incapable of receiving copy sheets at a rate at which said copy sheets are output from said duplex paper path when operating in said burst mode.

24. The method of claim 23, wherein a skipped pitch is inserted between each consecutively output copy sheet when scheduling is conducted in said interleave mode.

25. The method of claim 23, wherein said determining step includes:

determining whether said copy sheets are to be output to a final destination which includes a signature booklet maker; and determining to schedule said copy sheets in said burst mode unless it is determined that said final destination is said signature booklet maker.

26. The method of claim 25, wherein said determining step is also based upon the selected pitch mode.

27. The method of claim 23, wherein said sheet inverter immediately conveys inverted copy sheets toward said imaging station for side two imaging so that said duplex paper path loop is a buffer-trayless duplex path loop, and thus any skipped pitches in the output of copy sheets from said duplex paper path loop are based upon the manner in which said copy sheets are inserted into said duplex paper path loop.

28. The method of claim 23, wherein small copy sheets are fed through said duplex paper path long edge first when M=8, and large copy sheets are fed through said duplex paper path short edge first when M=4.

* * * * *